US008556387B2

(12) United States Patent
Nakashima et al.

(10) Patent No.: US 8,556,387 B2
(45) Date of Patent: Oct. 15, 2013

(54) INK JET HEAD UNIT AND INK JET RECORDING APPARATUS MOUNTED WITH THE SAME

(75) Inventors: Hiroaki Nakashima, Kasuga (JP); Kazunari Chikanawa, Tamana (JP); Seishi Tomari, Fukuoka (JP); Hiroyuki Matsuba, Ohnojo (JP); Tohru Nakagawa, Kusatsu (JP); Hideo Torii, Higashiosaka (JP); Takeshi Kamada, Nara (JP)

(73) Assignee: Panasonic Corporation, Osaka (JP)

( * ) Notice: Subject to any disclaimer, the term of this patent is extended or adjusted under 35 U.S.C. 154(b) by 2096 days.

(21) Appl. No.: 10/833,290

(22) Filed: Apr. 28, 2004

(65) Prior Publication Data

US 2005/0001881 A1 Jan. 6, 2005

(30) Foreign Application Priority Data

Apr. 28, 2003 (JP) ..... P.2003-124099
Apr. 28, 2003 (JP) ..... P.2003-124100
Apr. 28, 2003 (JP) ..... P.2003-124101
Apr. 28, 2003 (JP) ..... P.2003-124102

(51) Int. Cl.
*B41J 2/14* (2006.01)

(52) U.S. Cl.
USPC ..... 347/50

(58) Field of Classification Search
USPC ..... 347/20, 40, 50, 54, 57, 58, 59, 47, 56, 347/68, 70
See application file for complete search history.

(56) References Cited

U.S. PATENT DOCUMENTS

| | | | | |
|---|---|---|---|---|
| 4,627,673 | A * | 12/1986 | Barrus, Jr. | 439/92 |
| 5,469,199 | A | 11/1995 | Allen et al. | |
| 6,053,598 | A | 4/2000 | Inpyn | |
| 6,109,736 | A | 8/2000 | Miyata et al. | |
| 6,390,597 | B1 * | 5/2002 | Fujimoto et al. | 347/40 |
| 6,755,511 | B1 * | 6/2004 | Moynihan et al. | 347/68 |
| 2002/0033857 | A1 * | 3/2002 | Ohashi et al. | 347/20 |

FOREIGN PATENT DOCUMENTS

| | | |
|---|---|---|
| EP | 0 677 388 A2 | 10/1995 |
| EP | 0 863 007 | 9/1998 |
| JP | 58-105585 | 6/1983 |
| JP | 2-88100 | 3/1990 |
| JP | 04-133780 | 5/1992 |
| JP | 4-349675 | 12/1992 |

(Continued)

OTHER PUBLICATIONS

Decision of Refusal (in English language) issued May 1, 2008.

(Continued)

*Primary Examiner* — Lisa M Solomon
(74) *Attorney, Agent, or Firm* — Wenderoth, Lind & Ponack, LLP

(57) ABSTRACT

An ink jet head unit including a head (2) in which a plurality of nozzle arrays (2*a*, 2*b*, 2*c*, 2*d*) are formed. Each of the nozzle arrays has a number of nozzle holes, and ink can be ejected from the nozzle holes. The head (2) is mounted on the head base, and flat cables (4*a*, 4*b*) are connected at one end to mounting parts (7*a*, 7*b*), which are interposed between a first pair of the nozzle arrays (2*a*, 2*b*) and a second pair of the nozzle arrays (2*c*, 2*d*). The flat cables are flexibly formed by covering transmission wires with an insulation film. The flat cables are connected to the head to transmit ink ejection signals for driving the head.

25 Claims, 37 Drawing Sheets

(56) References Cited

FOREIGN PATENT DOCUMENTS

| | | |
|---|---|---|
| JP | 07-266569 | 10/1995 |
| JP | 2000-343690 | 12/2000 |
| JP | 2001-162892 | 6/2001 |
| JP | 2002-032137 | 1/2002 |
| JP | 3302785 | 4/2002 |
| JP | 2002-240283 | 8/2002 |
| WO | 01/25018 | 4/2001 |
| WO | 02/074545 A1 | 9/2002 |

OTHER PUBLICATIONS

JPO Notification of Reasons for Refusal dated May 23, 2008.
European Office Action issued Jun. 3, 2009 in corresponding European Patent Application No. 04729734.6.

* cited by examiner (BLACK SPOT IS DUST ONLY)

BLACK SPOT IS MELT PORTION

INK JET HEAD UNIT AND INK JET RECORDING APPARATUS MOUNTED WITH THE SAME

BACKGROUND OF THE INVENTION

1. Field of the Invention

The present invention relates to an ink jet unit and an ink jet recording apparatus mounted with the ink jet unit.

2. Description of Related Art

An ink jet head unit used in a conventional ink jet recording apparatus will be described.

FIG. 41 is a perspective view showing a conventional ink jet head unit, and FIG. 42 is a front view showing a head and a flat cable in the ink jet head unit of FIG. 41.

As shown in FIGS. 41 and 42, the conventional ink jet head unit includes a head 20 from which ink is ejected, a head base 21 on which the head 20 is mounted, and two flat cables 22*a*, 22*b* which are attached to the head 20 and pulled out from the head 20 in two different directions. In midway positions of the flat cables 22*a*, 22*b*, drivers 23*a*, 23*b* that generate ink ejection signals for driving the head 20 are respectively provided. Heat radiating plates 24*a*, 24*b*, for efficiently radiating heat generated during operation, are attached to the drivers 23*a*, 23*b*. In the head 20, two nozzle arrays 20*a*, 20*b* of which each comprises many nozzle holes are formed, and ink is ejected from these nozzle holes.

In such an ink jet head unit, conventionally, mounted parts 25*a*, 25*b* are formed between the nozzle arrays 20*a*, 20*b* and side portions of the head, and the flat cables 22*a*, 22*b* are fixed at the mounted parts 25*a*, 25*b* onto the head 20.

Here, the head 20 is composed of a laminate of thin films constituting the nozzle hole, a pressure chamber, an ink flow path, and an actuator. These thin films are weak in close attachment power in the vicinity of the side portions. Therefore, the mounted parts 25*a*, 25*b* must be formed not in the vicinity of the side portions of the head but at portions which are distant from the side portions, that is, on the insides of the side portions.

According to the conventional construction, the mounted part must be formed on the inside of the head. Therefore, a dead space is formed between the mounted part and the side portion of the head, so that the size of the head becomes large.

Here, in the case where the flat cable pulled out from the head is bent with a small curvature, since there is a fear of breaking of wire, it must be bent with a curvature of some degree. In this case, in the conventional ink jet head unit in which the mounted part is formed between the nozzle array and the side portion of the head, the flat cable sticks out of a width W of the head orthogonal to a surface of the flat cable.

In the conventional construction, not only the head itself is made large but also the pull-around space of the flat cable connected to the head is required in the width direction. Therefore, the ink jet head unit itself becomes large, which is contrary to a market request of miniaturization.

SUMMARY OF THE INVENTION

Therefore, an object of the invention is to provide an ink jet head unit in which a head having a mounted part connected to a flat cable can be miniaturized.

Further, another object of the invention is to provide an ink jet head unit in which the flat cable connected to the head can be compactly pulled around.

In order to solve these problems, an ink jet head unit of the invention comprises a head in which plural nozzle arrays of which each comprises many nozzle holes are formed, and ink is ejected from the nozzle holes; a head base on which the head is mounted; and a flat cable flexibly formed by covering many transmission wires with an insulation film. One end of the flat cable, where the transmission wires are exposed, is fixed in a mounted part interposed between the nozzle arrays onto the head to thereby transmit an ink ejection signal for driving the head.

According to this invention, since the mounted part is formed in the position between the nozzle arrays, the nozzle hole which is comparatively difficult to receive an influence caused by weak close attachment power of thin films constituting the head can be formed at a side portion of the head, so that the mounted part and the nozzle arrays can be arranged on the head efficiently. Therefore, a dead space is eliminated, and the head can be miniaturized.

Further, since the mounted part is formed in the position between the nozzle arrays, even in a case where the flat cable is arranged within a width of the head in a direction orthogonal to a surface of the flat cable, along the head base, the flat cable can be bent with a comparatively large curvature such that breaking of wire can be prevented, and the flat cable can be pulled around compactly.

DETAILED DESCRIPTION OF THE PREFERRED EMBODIMENTS

First Embodiment

Figure 1:
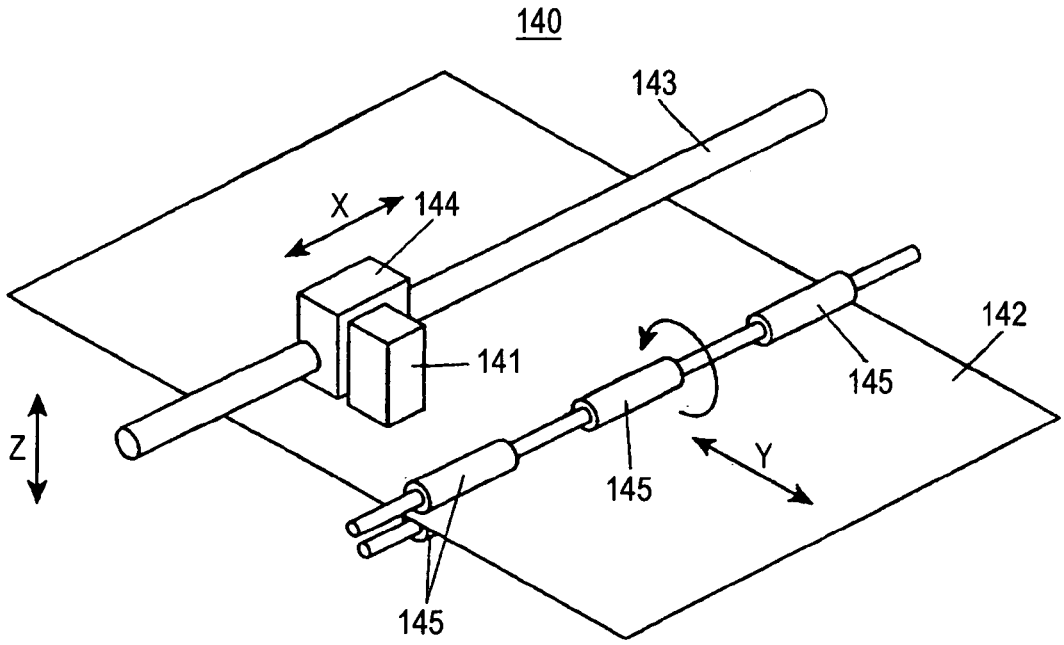
FIG. 1 is a perspective view schematically showing an ink jet recording apparatus according to one embodiment of the invention.

An embodiment of the invention will be described below with reference to FIGS. 37 to 40. In these drawings, the same members are denoted with the same reference numerals, and the overlapping description is omitted.

Figure 37:
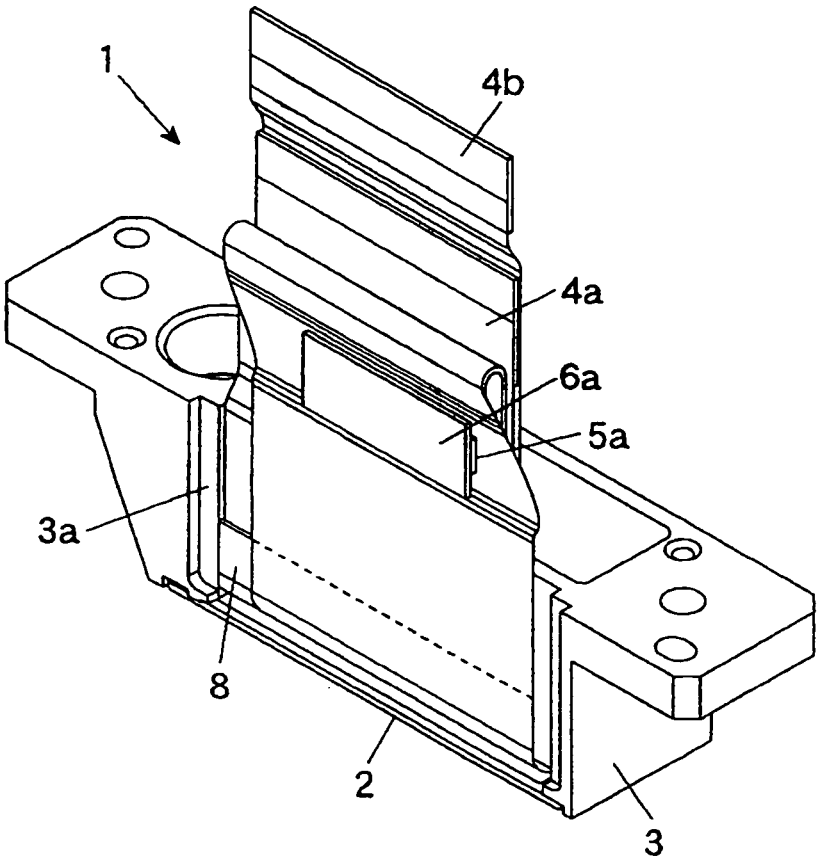
FIG. 37 is a perspective view showing an ink jet head unit according to one embodiment of the invention.
Figure 38:
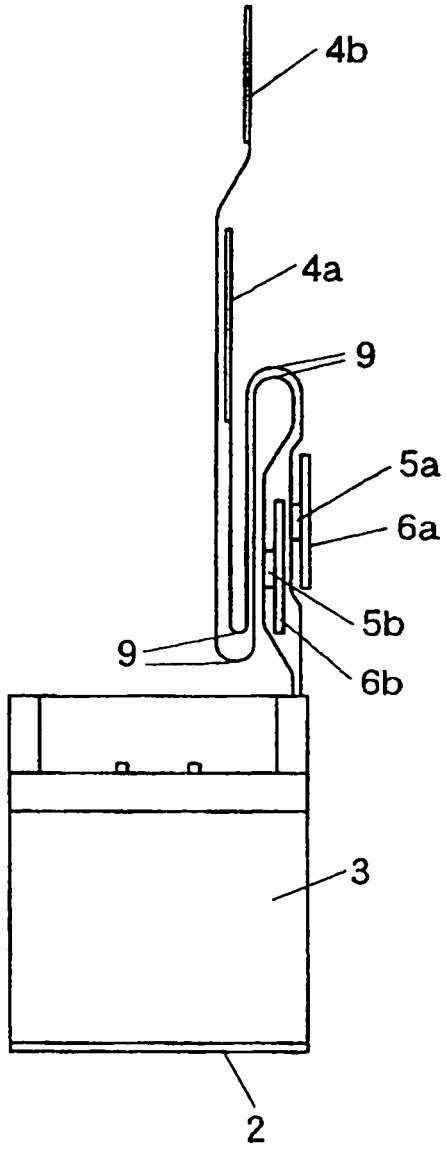
FIG. 38 is a side view of the ink jet head unit of FIG. 37.
Figure 39:
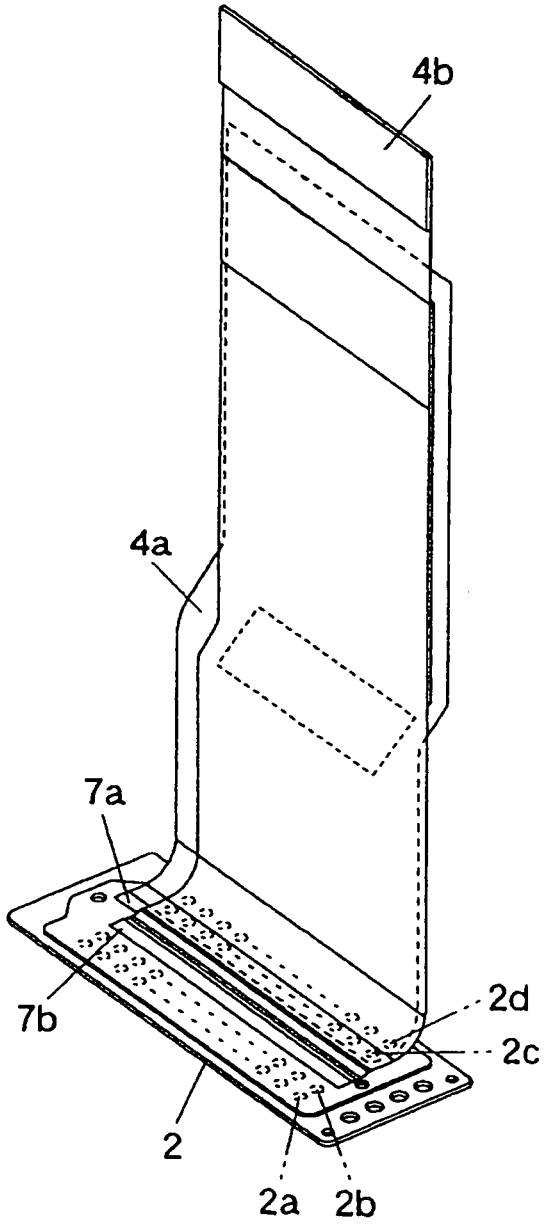
FIG. 39 is a perspective view of the ink jet head unit of FIG. 37, in which only a head and a flat cable are shown.
Figure 40:
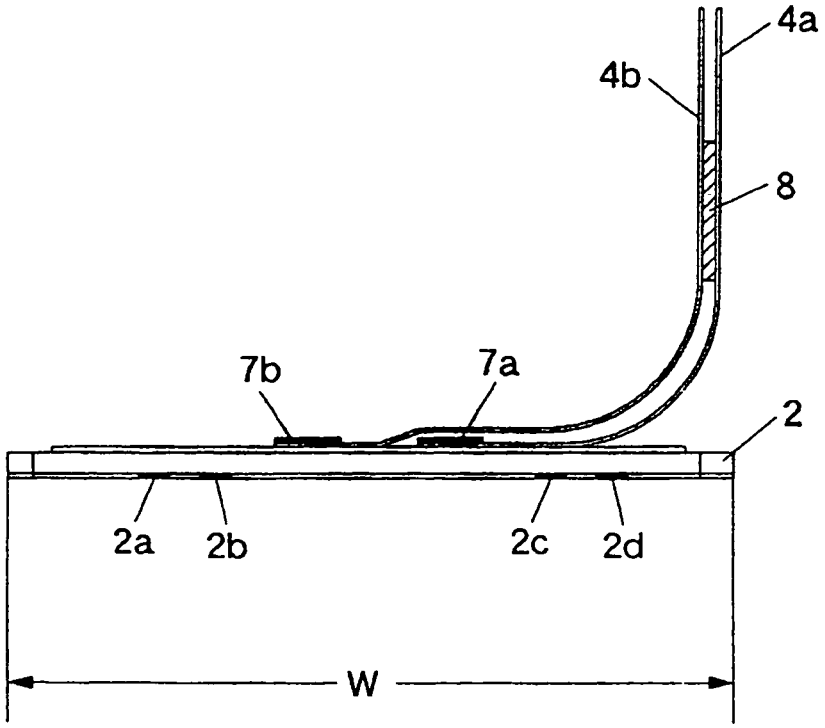
FIG. 40 is a side view showing a main portion of FIG. 39.
Figure 41:
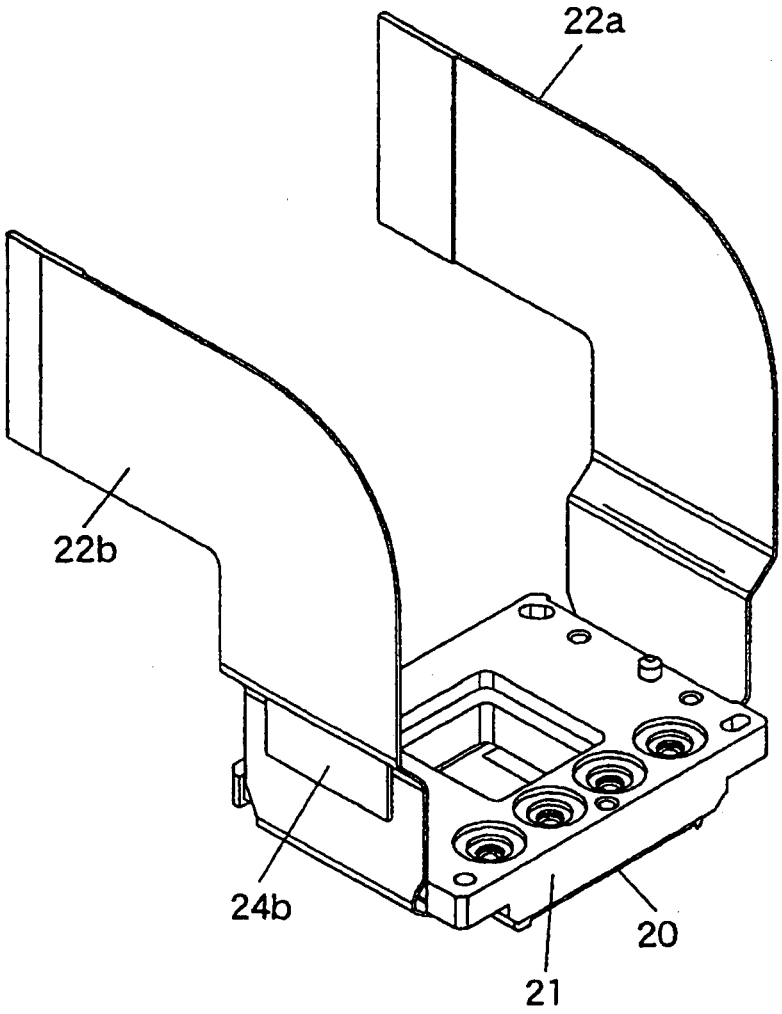
FIG. 41 PRIOR ART
FIG. 41 is a perspective view showing a conventional ink jet head unit.
Figure 42:
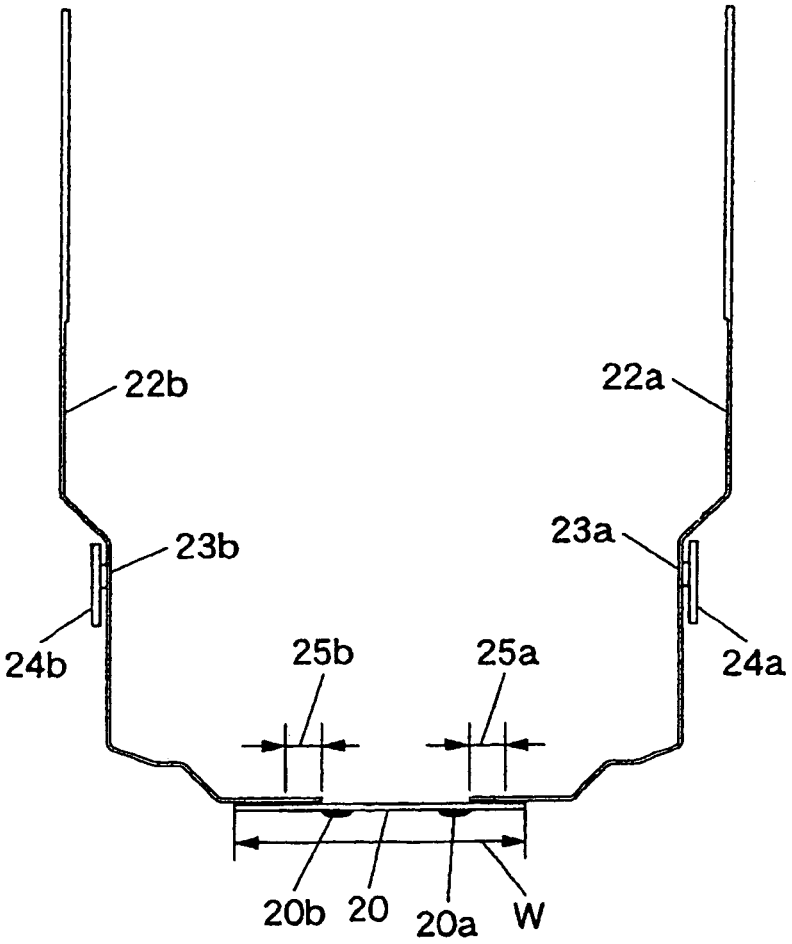
FIG. 42 PRIOR ART
FIG. 42 is a front view showing a head and a flat cable in the ink jet head unit of FIG. 41.

FIG. 37 is a perspective view showing an ink jet head unit according to one embodiment of the invention, FIG. 38 is a side view of the ink jet head unit of FIG. 37, FIG. 39 is a perspective view of the ink jet head unit of FIG. 37, in which only a head and a flat cable are shown, and FIG. 40 is a side view showing a main portion of FIG. 39.

An ink jet head unit 1 shown in FIGS. 37 and 38 is mounted on an ink jet recording apparatus (not shown) which ejects an ink droplet from a head 2 by use of a piezoelectric effect of a dielectric thin film element, and impacts the ink droplet onto a recording medium such as paper thereby to perform recording. The head 2 is composed of a laminate of thin films constituting a nozzle hole, a pressure chamber, an ink flow path, and an actuator.

The ink jet head unit 1 comprises the head 2 from which the ink is ejected, a head base 3 on which the head 2 is mounted, and two flexible flat cables 4*a*, 4*b* that are attached to the head 2. The flat cables 4*a* and 4*b* are formed by covering many transmission wires with an insulation film, and drivers 5*a* and 5*b* that generate an ink ejection signal for driving the head 2 are provided respectively in midway positions of the plural flat cables. Heat radiation plates 6*a* and 6*b* for efficiently radiating heat generated during operation are attached to the drivers 5*a* and 5*b*.

As shown in FIG. 39, four nozzle arrays 2*a*, 2*b*, 2*c*, and 2*d* are formed, each of which comprises a plurality of nozzle holes, and ink is ejected from these nozzle holes. The nozzle arrays are positioned adjacent to each other two by two, that is, the nozzle arrays 2*a* and 2*b* form a pair and the nozzle arrays 2*c* and 2*d* form a pair. Two mounted parts 7*a* and 7*b* are formed between the nozzle arrays 2*a*, 2*b* and the nozzle arrays 2*c*, 2*d*.

One end side of the flat cable 4*a*, where the transmission wires are exposed, is fixed in the mounted part 7*a* onto the head 2, and one end side where the transmission wires of the flat cable 4*b* are exposed is fixed in the mounted part 7*b* onto the head 2. Further, as shown in FIG. 40, the flat cables 4*a* and 4*b* extend respectively in the same direction from the mounted or mounting parts 7*a* 7*b* that are in the fixed positions of the head. Further, the flat cables 4*a* and 4*b* may be fixed onto the head 2 so as to extend in different directions.

The ink ejecting signals generated by the drivers 5*a* and 5*b* are transmitted to the flat cables 4*a* and 4*b*, and supplied to the head 2 from the flat cables 4*a* and 4*b*. The dielectric thin film element is subjected to displacement, and the ink droplet is ejected.

In the embodiment, though four nozzle arrays are formed, two or more, that is, plural nozzle arrays are sufficient, and thus the invention is not limited to the four arrays. Further, though two flat cables are used, one, or three or more flat cables may be used.

Since the mounted parts 7*a* and 7*b* are thus located in the position between the nozzle arrays 2*a*, 2*b* and the nozzle arrays 2*c*, 2*d*, the nozzle holes which are comparatively difficult to receive an influence caused by weak close attachment power of thin films constituting the head 2 can be formed at side portions of the head. Thus, since the mounted parts 7*a*, 7*b* and the nozzle arrays 2*a*, 2*b*, 2*c*, 2*d* can be arranged on the head 2 efficiently, a dead space is eliminated, and the head 2 can be miniaturized.

Further, since the mounted parts 7*a* and 7*b* are formed in the position between the nozzle arrays 2*a*, 2*b* and the nozzle arrays 2*c*, 2*d*, even in the case where the flat cables 4*a* and 4*b* are arranged within a width W of the head 2 in a direction orthogonal to a surface of the flat cable, along the head base 3 (FIG. 40), the flat cables can be bent with such a comparatively large curvature that breaking of the wire(s) can be prevented, so that the flat cables 4*a* and 4*b* can be pulled around compactly.

A notch part 3*a* is formed on a side surface of the head base 3. The flat cables 4*a* and 4*b* that are thus pulled around are fitted into the notch part 3*a*. Thus, the flat cables 4*a* and 4*b* can be compactly housed within the width of the head 2 in the direction orthogonal to the surface of the flat cable.

A metallic interference preventing member 8 or a nonmetallic interference preventing member 8 in which a metal layer is formed is arranged between the flat cables 4*a* and 4*b*. Accordingly, electromagnetic mutual interference between the flat cables 4*a* and 4*b* is relaxed. The interference preventing member may not be provided. Further, though the interference preventing member 8 is arranged at a part between the flat cables 4*a* and 4*b* in the figure, it may be arranged throughout the space between the flat cables 4*a* and 4*b*.

Further, as another means for relaxing the electromagnetic mutual interference, the flat cables 4*a* and 4*b* may be arranged so that the transmission wires formed in these flat cables 4*a* and 4*b* are not parallel to each other.

As shown in FIG. 38, the drivers 5*a* and 5*b*, to which the heat radiation plates 6*a* and 6*b* are attached, are arranged so as to shift from each other in the length direction of the flat cables 4*a*, 4*b*. Thereby, since the drivers 5*a* and 5*b* having heat during the operation are distant from each other, heat radiation efficiency of the respective heat radiation plates is prevented from being lessened due to adjacency between the heat radiation plates 6*a* and 6*b*. Further, as described before, since the flat cable 4*a* is fixed onto the mounted part 7*a* and the flat cable 4*b* is fixed onto the mounted part 7*b* that is in a different position relative to the position of the mounted part 7*a*, even in a case where the attachment positions of the driver 5*a* and the driver 5*b* to the flat cable 4*a* and the flat cable 4*b* are not made different, the shift arrangement can be readily performed.

The flat cables 4*a* and 4*b* have respectively at least two bending parts 9 that bend in the length direction of each of the flat cables 4*a*, 4*b*, at their parts extending from the head base 3. Thereby, an extra length can be provided for the flat cables 4*a*, 4*b*, so that work performance in assembly of the apparatus can be improved by adjusting the position of the bending part 9.

As described above, according to the ink jet head unit of the embodiment, since the mounted parts 7*a*, 7*b* are located between the nozzle arrays 2*a*, 2*b* and the nozzle arrays 2*c*, 2*d*, the nozzle holes which are comparatively difficult to receive the influence caused by weak close attachment power of the thin films constituting the head 2 can be formed at the side portions of the head, so that the mounted parts 7*a*, 7*b* and the nozzle arrays 2*a*, 2*b*, 2*c*, 2*d* can be arranged on the head 2 efficiently. Therefore, the dead space is eliminated, and the head 2 can be miniaturized.

Further, since the mounted parts 7*a*, 7*b* are formed in the position between the nozzle arrays 2*a*, 2*b* and the nozzle arrays 2*c*, 2*d*, even in the case where the flat cables 4*a*, 4*b* are arranged within the width W of the head 2 in the direction orthogonal to the surface of the flat cable, along the head base 3, the flat cables can be bent with a comparatively large curvature such that breaking of wire(s) can be prevented, and the flat cables 4*a*, 4*b* can be pulled around compactly.

Second Embodiment

Embodiments of the invention will be described below with reference to FIGS. 1 to 10. In these drawings, the same members are denoted by the same reference numerals, and the overlapping description is omitted.

An ink jet recording apparatus 140 shown in FIG. 1 is provided with an ink jet head 141 which performs recording by use of a piezoelectric effect of a piezoelectric element that is an actuator, and impacts ink droplets ejected from this ink jet head 141 onto a recording medium 142 such as paper thereby to perform recording on the recording medium 142. The ink jet head 141 is mounted on a carriage 144 provided on a carriage shaft 143 arranged in a main scanning direction X, and reciprocates in the main scanning direction X correspondingly to reciprocation of the carriage 144 along the carriage shaft 143. Further, the ink jet recording apparatus 140 has plural rollers (moving unit) 145 which move the recording medium 142 in a sub-scanning direction Y that is nearly perpendicular to the width direction (i.e., main scanning direction X) of the ink jet head 141.

In FIG. 1, though the number of the ink jet heads 141 is one, it may be two or more. In a case where the number of the heads increases, the distance at which the ink jet head 141 is moved in the X-axis direction can be reduced when an image is formed on the recording medium. Therefore, an image forming speed improves.

Next, the structure of the ink jet head 141 will be described with reference to FIG. 2.

Figure 2:
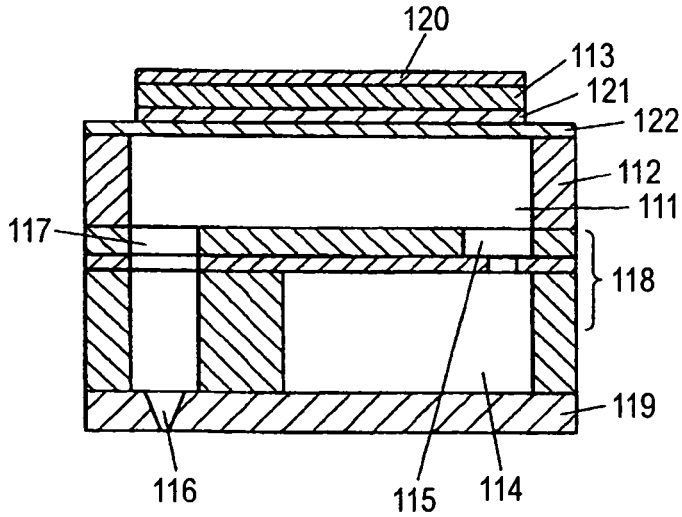
FIG. 2 is a sectional view showing an ink jet head used in the ink jet recording apparatus of FIG. 1.

FIG. 2 is a sectional view of the ink jet head. The ink jet head 141 has a pressure chamber plate 112 in which a pressure chamber 111 is formed and into which ink liquid is filled. Also, a piezoelectric element 113 such as a PZT film, functioning as an actuator, is formed on the pressure chamber 111.

A common liquid chamber plate 118 is bonded to the pressure plate 112, and a common liquid chamber 114 that supplies the ink liquid into the pressure chamber 111 is arranged in the ink liquid supply direction. An ink flow inlet 115 communicates the common liquid chamber 114 and the pressure chamber 111, and a communication hole 117 communicates a nozzle hole 116 (described later) and the pressure chamber 111. A nozzle plate 119 is bonded to the common liquid chamber plate 118, and the nozzle hole 119, which communicates with the pressure chamber 111 and ejects an ink droplet, is formed in the nozzle plate 119.

On the pressure chamber 111, the piezoelectric element 113, and an upper individual electrode 120 corresponding to the pressure chamber 111 and a lower common electrode 121 which apply a voltage to the piezoelectric element 113 to thereby mechanically displace (contraction and expansion) the piezoelectric element 113, are formed; and a vibration plate 122 is formed between the common electrode 121 and the pressure chamber plate 112.

The piezoelectric element 113 is subjected to displacement by the piezoelectric effect due to the voltage applied to the common electrode 121 and the individual electrode 120 corresponding to the pressure chamber 111, and the vibration plate 122 that vibrates following this displacement changes the volume of the pressure chamber 111, so that the ink liquid in the pressure chamber 111 is ejected from the nozzle hole 116.

In this embodiment, the common electrode 121 and the vibration plate 122 are formed separately. However, they may be formed integrally.

In the ink jet head, with the above structure forming one unit, the units of the same structure are periodically arranged in the vertical direction to a paper surface of FIG. 2. As a result, ink can be ejected from the many nozzle holes 116. The liquid chamber is common to each unit, and the ink of the same color is ejected from the many nozzles. Since it is necessary to eject ink of four colors in order to perform color printing, at least four common liquid chambers are necessary. Usually, in the ink jet head, the nozzle holes 116 for ejecting ink of one color are linearly arranged on the nozzle plate 119 at equal intervals. In order to eject the ink of four colors from the ink jet head, at least four nozzle arrays for ejecting ink of each color are arranged. As forming methods of the individual electrode 120, the piezoelectric element 113, the common electrode 121, and the vibration plate 122, the known various film forming methods are appropriately adopted. Examples of known methods include a thick film forming method such as screen printing, a coating method such as dipping, sputtering, a CVD method, a vacuum evaporation method, a sol-gel processing, and a thin film forming method such as plating. However, the forming methods are not limited to the above methods.

Figure 3:
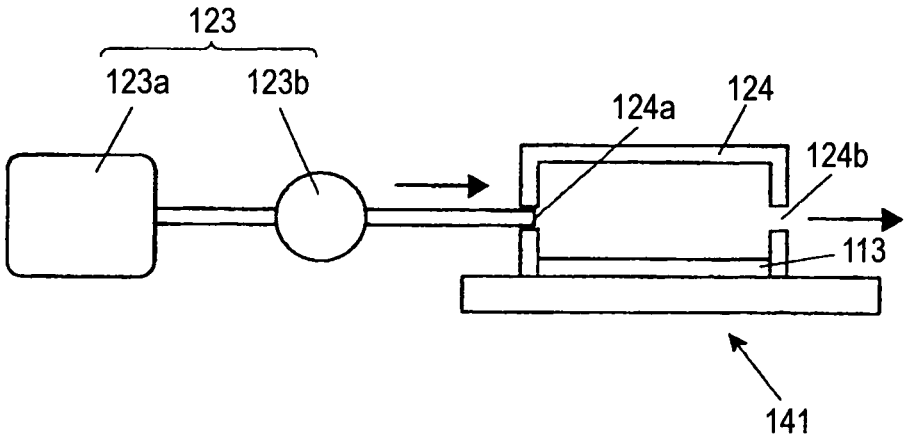
FIG. 3 is a conceptual diagram showing a main portion of the ink jet recording apparatus according to one embodiment of the invention.

As shown in FIG. 3, in the ink jet recording apparatus 140, there is provided a dew point control unit 123 which maintains a dew point in an atmosphere of the piezoelectric element 113 and the vicinity of the piezoelectric element 113 at a lower value than a dew point in an environment where the ink jet recording apparatus 140 is set.

The dew point control unit 123, by introducing gas of a low humidity (for example, dew point −60° C.), for example, dry air, nitrogen gas, or argon gas to the piezoelectric element 113 and in the vicinity of the piezoelectric element 113, lowers the dew point. Namely, the dew point control unit 123 passes the gas from a compressor 123*a* to an air drier 123*b* thereby to remove moisture, and supplies this gas from an inlet 124*a* of a case 124 to the piezoelectric element 113 and the vicinity of the piezoelectric element 113. The dry gas introduced into the case 124 is discharged from an outlet 124*b* formed in the case 124 to the outside. However, without providing the case 124, the dry gas may be blown to the piezoelectric element 113.

Further, as the air drier 123*b*, a freeze type air drier which lowers the temperature thereby to remove the moisture in the gas; a filter type air drier which lets the gas pass through a filter thereby to remove the moisture in the gas; and absorption type air drier which lets the gas pass through absorbent such as silica gel thereby to remove the moisture in the gas can be used.

Figure 4:
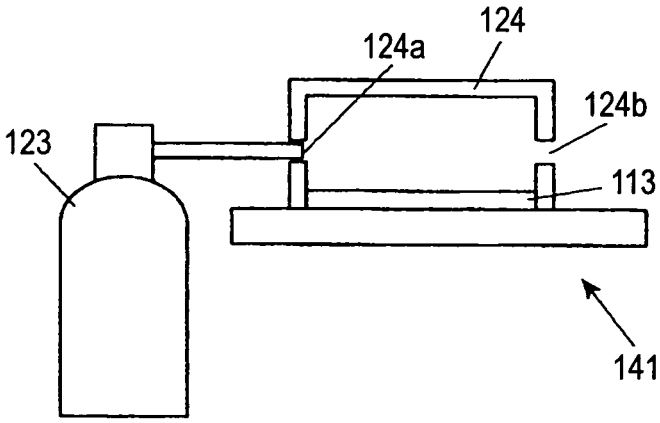
FIG. 4 is a conceptual diagram showing a main portion of an ink jet recording apparatus according to another embodiment of the invention.

Further, as the dew point control unit, as shown in FIG. 4, a gas cylinder 123 into which dry gas is sealed may be used to supply the dry gas in the cylinder.

Further, as the dew point control unit for supplying the dry gas, using piping of dry gas installed in a building as a plant, the dry gas can be also supplied.

Figure 5:
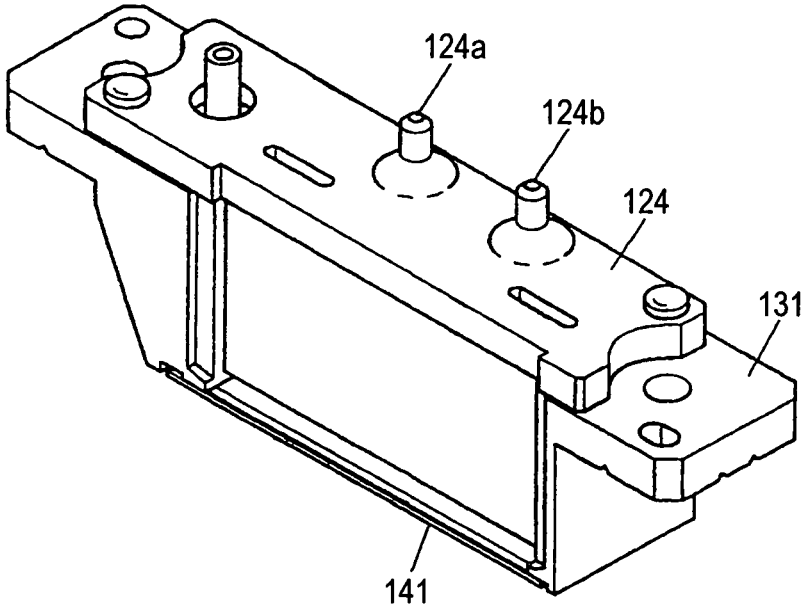
FIG. 5 is a perspective view showing an introduction form of dry gas to an ink jet head attached to a head base.

More, specifically, as shown in FIG. 5, the case 124 can be attached to a head base 131 to which the ink jet head 141 has been attached thereby to supply the dry gas. Inlet 124*a* and outlet 124*b* are formed on the same plane.

Figure 6:
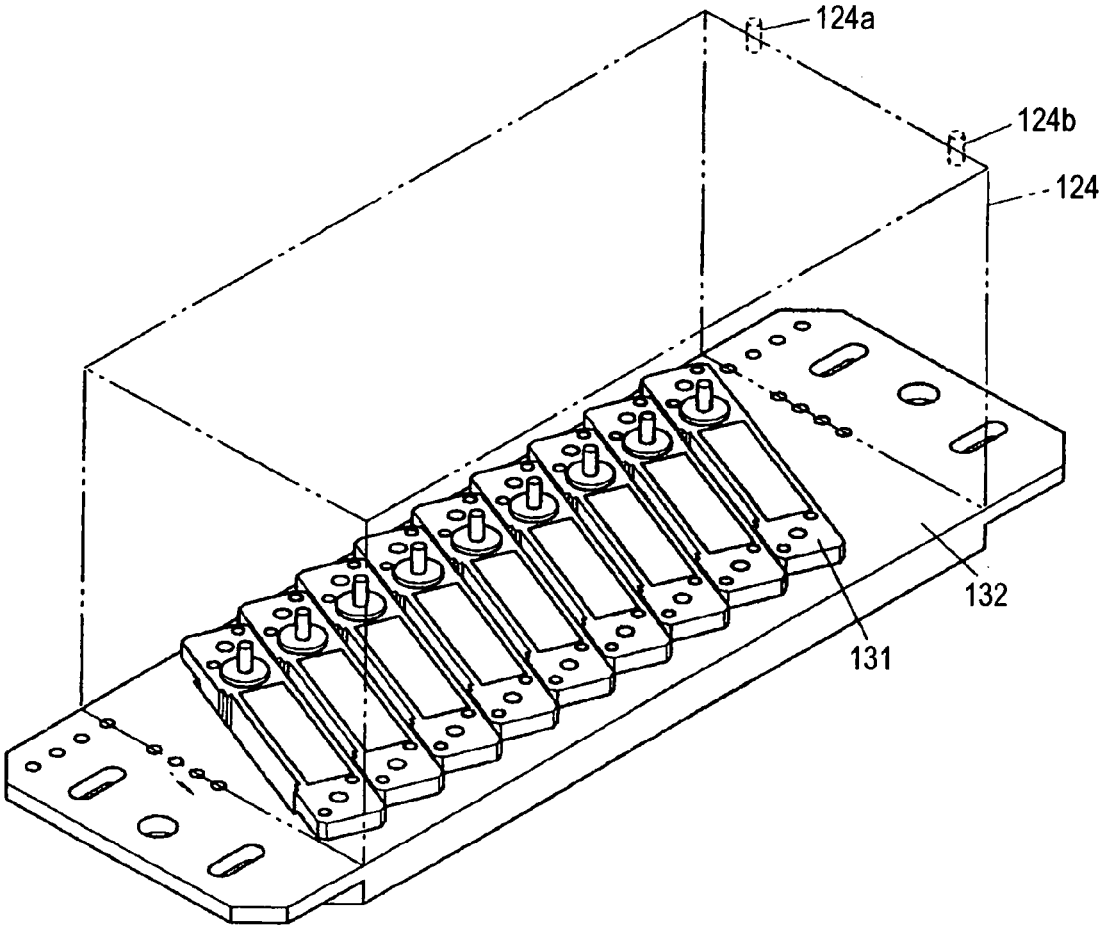
FIG. 6 is a perspective view showing an introduction form of dry gas to an ink jet head attached to a frame through the head base.

Further, in case that there are the many ink jet heads, as shown in FIG. 6, plural head bases 131 for fixing the respective ink jet heads may be arranged and fixed to a frame 132, and the case 124 may be attached to this frame 132, thereby to supply the dry air.

The inventor, in order to seize characteristics of the piezoelectric element 113 in a dry atmosphere, has manufactured a sample element having the following structure and evaluated it.

Namely, on a silicon substrate having a diameter of 3 inch and a thickness of 0.5 mm, platinum of 100 nm has been evaporated as the lower electrode by sputtering, sequentially $PbZr_{0.5}Ti_{0.5}O_3$ (hereinafter referred to as "PZT") of 3 μm has been evaporated as the piezoelectric element, and sequentially platinum of 100 nm has been evaporated as the upper electrode. Thereafter, the silicon substrate has been cut into 20 mm by 20 mm, and platinum of the area of 5 mm by 7.5 mm has been evaporated on the PZT by use of a metal mask.

Further, as the air drier, a super drier unit SU3015B7 by CKD Company has been used. This air drier comprises an air filer for removing dust in air, an oil mist filter for removing an oil component in air, a drier body for removing moisture in air, and a regulator for regulating pressure. The drier body is composed of many hollow fibers made of special resin, and the compressed air passes through this hollow fiber. The resin constituting the hollow fiber has such a property that only moisture is caused to selectively pass through the outside of the hollow fiber, and air including the moisture passes through the hollow fiber, whereby the moisture in air is removed. In the embodiment, in order to generate dry air, compression air of about 0.5 Mpa is introduced from the air filter side by the compressor 23*a*. The introduced compression air passes through the air filter and the oil mist filter, whereby the dust and the oil component are removed. Further, the compression air passes through the drier body, whereby the moisture is removed, and the dry air comes out from the outlet.

As an evaluation system, the aforementioned sample has been set in an acryl-made case having a size of 40 mm by 40 mm by 50 mm so that a voltage can be applied between the upper electrode and the lower electrode. Further, this system is constituted so that the dry air generated by the air drier 123*b* can be introduced into the case. To the air drier 123*b*, the compression air of 0.5 Mpa has been introduced by use of the compressor 123*a*, and a flow regulating valve has been regulated so as to introduce the dry air into the case at flow rate of 2 L/min. A dew point in the case when the dry air has been introduced has been −50° C. The case has been set in a constant humidity and temperature bath.

The reason why an introduction speed of the dry air is set to 2 L/min is as follows. Namely, in the embodiment, the generation of the dry air uses the dry air system, and the air including the moisture passes through the hollow fiber in the dry air system thereby to remove the moisture and generate the dry air. Since the amount of moisture that can be removed by the hollow fiber per time is limited, in case that the introduction flow rate is over the predetermined level, dry degree of the dry air lowers and the dew point increases. In the dry air system of this embodiment, in case that the introduction flow rate is in a range of 2 to 10 L/min, the dew point becomes −50° C.; and in case that the flow rate is over this value, the dew point increases. Therefore, the dry air is caused to flow at the flow rate of 2 L/min. Since the maximum flow rate by which the dry air can flow is determined by specification of the system, the introduction speed is not limited to 2 L/min but the dry air may be introduced at the flow rate by which the dew point of the generated dry air becomes −50° C. Further, from the experiments by the inventor, it has been proved that when the flow rate of the dry air introduced into the case is 10 mL/min or more per volume of one cubic cm, the dew point in the case 124 is kept at −50° C. or less.

Further, the pressure inside the case 124 when the dry air has been introduced is generally higher than the outside air pressure, which is one air pressure or more. However, according to an altitude of a place where the apparatus is used and weather, the pressure inside the case can become lower than the outside air pressure.

Further, in case that the inside of the case 124 is sealed, the internal pressure increases by the introduced dry air, and the moisture attached onto the actuator cannot be exhausted to the outside of the case 124. Therefore, it is necessary to provide an outlet 124*b* for the case 124 like this embodiment.

Next, evaluation items of the sample will be described.

A first evaluation item is a characteristic evaluation of PZT under an atmosphere where the temperature is 60° C. and the humidity is 80%. The temperature and the humidity in the constant temperature and humidity bath have been set at 60° C. and 80%. In a state where the dry air is introduced into the case, direct current of 35V has been applied for sixteen hours between the upper electrode of the sample and the lower electrode so that polarity of the lower electrode becomes positive, and thereafter, a surface of the sample has been observed with a microscope. Next, using the same sample, in a state where the dry air is not introduced, the direct current of 35V has been applied for three hours, and thereafter, the surface of the sample has been observed with the microscope.

A second evaluation item is a characteristic evaluation of PZT under an atmosphere where the temperature is 25° C. and the humidity is 50%. The temperature and the humidity in the constant temperature and humidity bath have been set at 25° C. and 50%. In a state where the dry air is introduced into the case, the direct current of 35V has been applied for 150 hours between the upper electrode of the sample and the lower electrode so that polarity of the lower electrode becomes positive, and thereafter, the surface of the sample has been observed with a microscope. Next, using the same sample, in a state where the dry air is not introduced, the direct current of 35V has been applied for one hour, and thereafter, the surface of the sample has been observed with the microscope.

Results on the above evaluation items will be described.

Figure 7A:
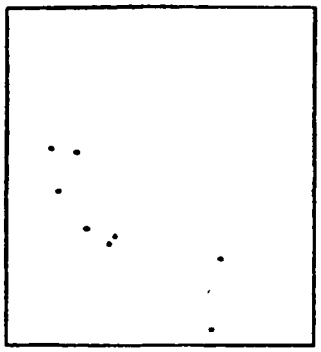
FIGS. 7A and 7B are diagrams showing characteristic evaluation of PZT after the direct voltage of 35V has been applied for the predetermined time under an atmosphere where the temperature is 60° C. and the humidity is 80%.
Figure 7A:
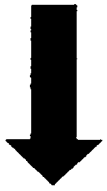
Figure 7B:
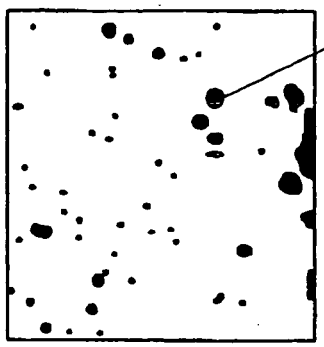

Regarding the first evaluation item, a microscopic photograph after the test is shown in FIG. 7. After the voltage has been applied in the state where the dry air is introduced, a remarkable change has been observed in the sample (FIG. 7A). On the other hand, in case that the dry air is not introduced, a large number of black spots have been observed in the sample surface (FIG. 7B). This black spot is a portion in which the upper electrode and the lower electrode have melted. The reason why the electrode melts is thought as follows. Namely, it is surmised that when the voltage is applied to the PZT under the environment of a high humidity, leak current flows in defects existing in the PZT and Joule heat generates, and the electrode melts by this heat.

Figure 8:
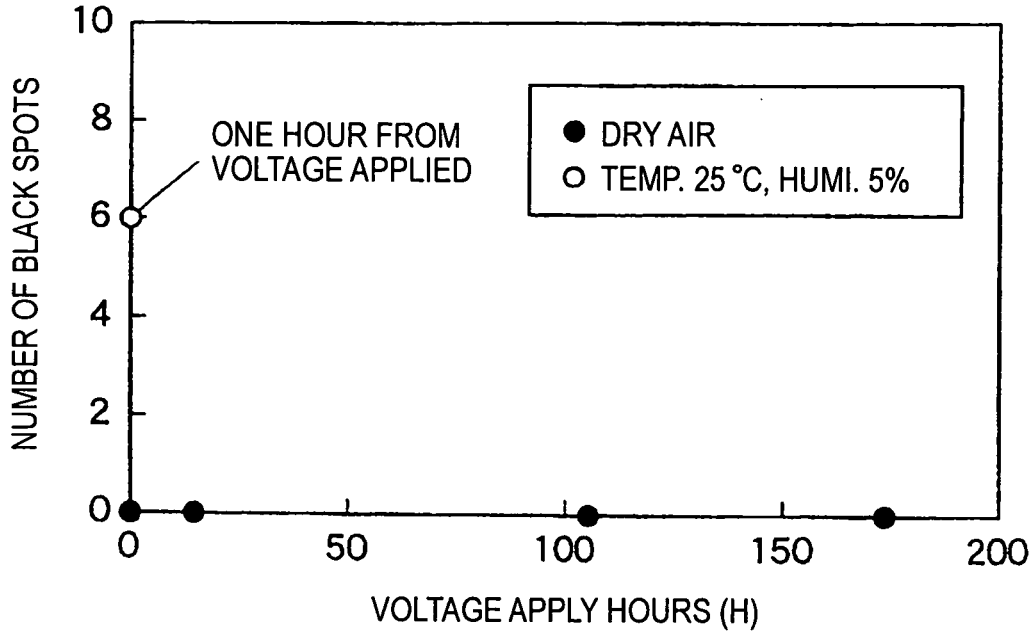
FIG. 8 is a graph showing a relationship between the voltage applied time to PZT and the number of black spots under an atmosphere where the temperature is 25° C. and the humidity is 50%.

Regarding the second evaluation item, as shown in FIG. 8, in case that the dry air has been introduced, even after the voltage has been applied for 150 hours, the black spots have not been produced. On the other hand, in case that the dry air is not introduced, six black spots has been produced by the voltage application for one hour.

As described above, by introduction of the dry air, even in case that the voltage has been applied to the PZT, any break has not occurred. Further, it is surmised that: a reason why the number of the black spots in the first evaluation item is larger than that in the second evaluation item is that since the temperature of air in the constant temperature bath in the first evaluation item is higher, the absolute amount of the included moisture is larger than that in the second evaluation item, so that the break of the PZT has advanced more.

Next, similarly to the case of the second evaluation item, PZT incorporated into an ink jet head has been evaluated (refer to FIG. 2). In this ink jet head, two hundreds pressure chambers and the corresponding actuators made of PZT are formed.

Figure 10A:
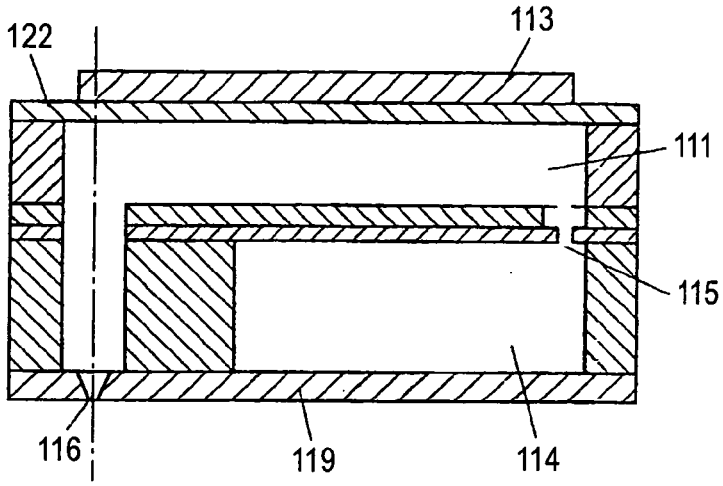
FIGS. 10A to 10C are explanatory views of the ink jet head.
Figure 10B:
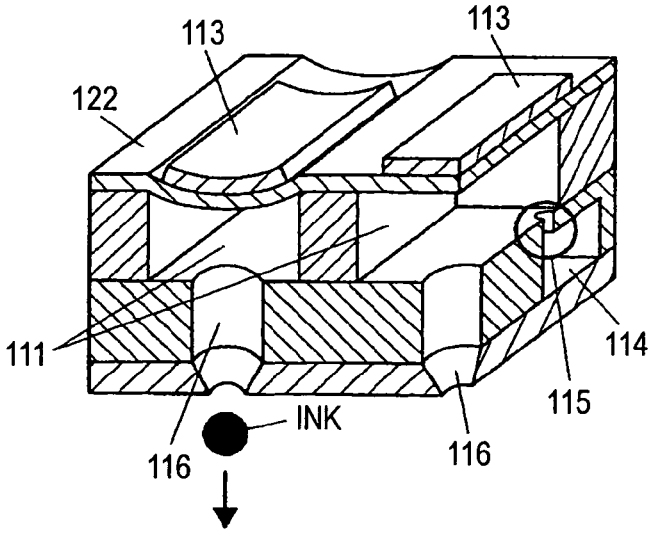
Figure 10C:
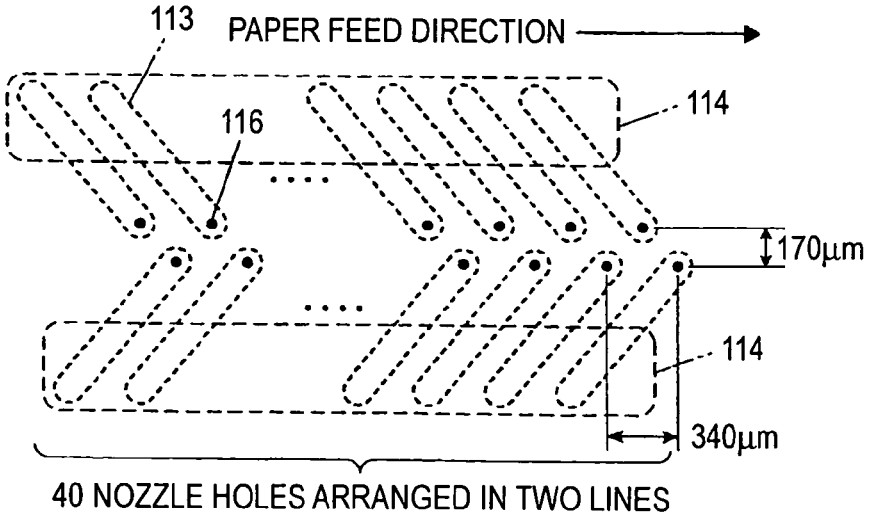

FIGS. 10A to 10C are explanatory diagrams of the ink jet head used in the evaluation, in which the sectional view of FIG. 2 is shown more detailedly. FIG. 10A is an explanatory view of the nozzle hole 116 and its vicinity. The nozzle hole 116 communicates with the pressure chamber 111, and the vibration plate 122 and the PZT that is the piezoelectric element 113 are formed above the pressure chamber 111. In this figure, the common electrode and the individual electrode between which the piezoelectric element is put are omitted. The pressure chamber is filled with ink, and the ink is supplied from the common liquid chamber 114 through the ink flow inlet 115. When the voltage is applied to the piezoelectric element 113, the piezoelectric element 113 and the vibration plate 122 bend, and the pressure in the pressure chamber 11 increases, so that the ink is ejected from the nozzle 116. Further, a surface of the nozzle plate 119 is subjected to water repellent treatment so that the ink can be ejected from the nozzle hole 116 in the fixed direction.

The piezoelectric element 113 is basically the same as the PZT used in the first and second evaluations, and it is 3 μm in thickness and 100 μm by 1200 μm in area. The vibration plate 122 is 3 μm in thickness.

FIG. 10B is an explanatory view which shows a section taken along a dotted line of FIG. 10A. Herein, though only the structure in the vicinity of about two nozzle holes 116 is shown, actually, many portions having the same structure as the structure shown in FIG. 10B are arranged in a row. The figure shows a state in which the left piezoelectric element 113 and vibration plate 122 bend and the ink is ejected from the nozzle hole 116. As known from the figure, one pressure chamber 111 and one piezoelectric element 113 are assigned to each nozzle hole 116. However, the common liquid chamber 114 which supplies the ink is common to the many nozzle holes 116, and the ink is supplied from the common liquid chamber 114 through the ink flow inlet 115 provided for each pressure chamber 111 (in the figure, the ink flow inlet 115 on the left pressure chamber 111 is covered with a wall partitioning the two pressure chambers 111 and cannot be seen.

FIG. 10C is an explanatory diagram, viewed from the upper portion of the nozzle plate 119. In this example, there are two nozzle arrays up and down, each of which comprises forty nozzle holes 116 arranged right and left at an interval of 340 μm. In the figure, a broken line surrounding each nozzle hole 116 represents the piezoelectric element 113 on the opposite side of the nozzle plate 119, and a nearly rectangular broken line represents the common liquid chamber 114. Since the ink is supplied from one common liquid chamber 114 to the forty nozzle holes 116 arranged right and left, the ink of the same color is ejected from the forty nozzle holes 116 arranged right and left. In the embodiment, an ink jet head having two hundreds nozzle holes 116 is used. Therefore, there are five arrays of the nozzle holes 116 in total.

Figure 9:
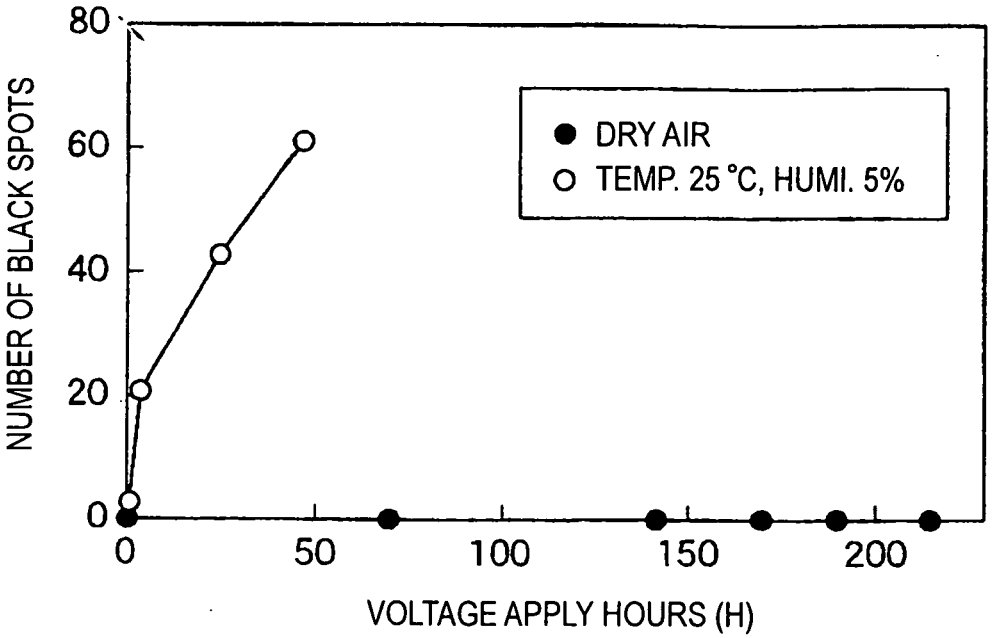
FIG. 9 is graph showing a relationship between the voltage applied time to a piezoelectric element functioning as an actuator and the number of the black spots under an atmosphere where the temperature is 25° C. and the humidity is 50%.

The ink jet head has been set in an acryl-made case so that the dry air generated by the air drier can be introduced into this case, and the case has been set in a constant temperature and humidity bath in which the temperature is 25° C. and the humidity is 50%. In the state where the dry air is introduced, the voltage has been applied so that the polarity of the common electrode becomes positive and that of the individual electrode becomes negative. Further, also in the state where the dry air is not introduced, the voltage has been similarly applied. An evaluation result is shown in FIG. 9. In case that the dry air has been introduced, even after the voltage has been applied for 200 hours or more, the black spots have not been produced at all. On the other hand, in case that the dry air is not introduced, sixty or more black spots have been produced in fifty hours in the PZT that is the actuator.

As described above, also in the PZT used for the actuator, by introducing the dry gas such as dry air, any break does not occur in the PZT at all even in case that the voltage is applied.

In the embodiment, since the piezoelectric element is manufactured by sputtering, a thin piezoelectric element that is good in crystal orientation can be obtained with good reproducibility. Therefore, also in case that the voltage applied to the piezoelectric element is small, the great displacement yields. Therefore, the ink can be ejected at a low voltage, so that consumed power of the printer can be reduced. Further, though the area of the used piezoelectric element is 100 μm by 1200 μm, the area can be reduced up to about 3 μm that is the film thickness of the piezoelectric element. As the area of the piezoelectric element is reduced, the in-plane density of the nozzle can be more improved, so that exacter printing can be performed.

As described above, according to this embodiment, since the dew point in the vicinity of the piezoelectric element is lowered by the dry gas, it is prevented that the piezoelectric element deteriorates due to the voltage application. Hereby, achieving reduction of the film thickness of the piezoelectric element, it is possible to readily prevent the element break due to the voltage application to this piezoelectric element.

In the above description, the direct voltage of 35V has been applied to the piezoelectric element to examine its characteristics. However, generally, it is not necessary to apply such the high voltage in order to eject the ink, and the voltage of a rectangular waveform is applied. Also in this voltage applied state, by introducing the dry gas, the deterioration of the piezoelectric element can be prevented, needless to say.

Further, in this embodiment, the PZT is used as the piezoelectric element. However, the invention is not limited to this, but another piezoelectric element including lead may be used because the similar effect can be obtained. Further, though the piezoelectric element is formed by sputtering in this embodiment, the invention is not limited to this, but a piezoelectric element manufactured by sintering or sol-gel processing may be used because the similar effect can be obtained.

As described above, according to the invention, since the dew point in the vicinity of the piezoelectric element is lowered by the dry gas, it is prevented that the piezoelectric element deteriorates due to the voltage application. Hereby, such an effective advantage can be obtained that it is possible to readily prevent the element break due to the voltage application to this piezoelectric element, achieving reduction of the film thickness of the piezoelectric element.

Third Embodiment

Embodiments of the invention will be described below with reference to FIGS. 11 to 23. In these drawings, the same members are denoted by the same reference numerals, and the overlapping description is omitted.

Figure 11:
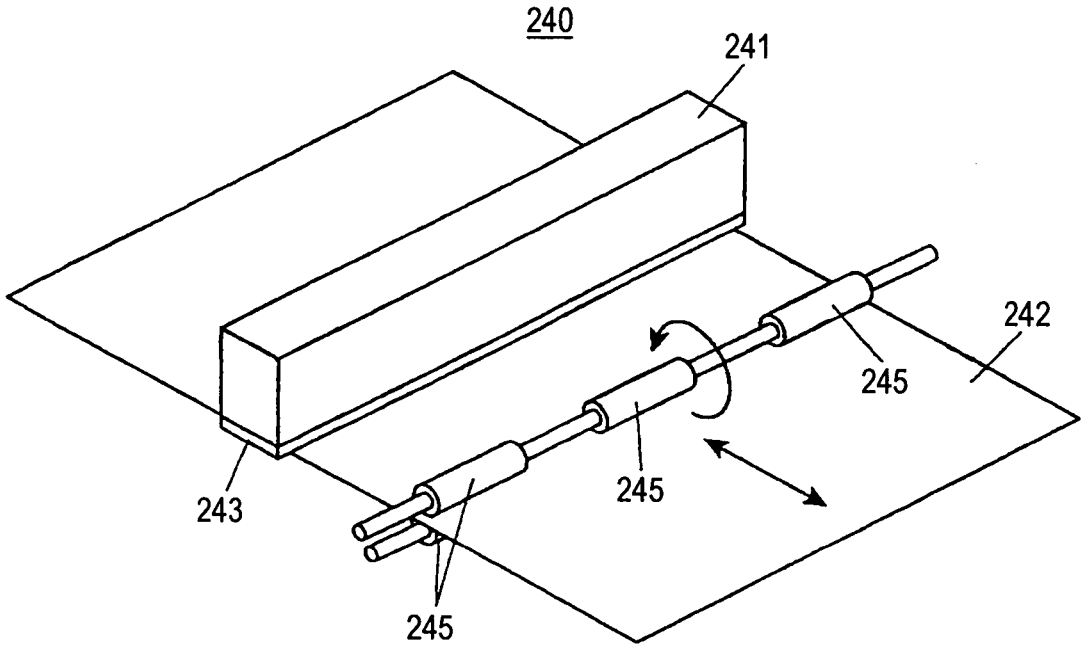
FIG. 11 is a schematic diagram showing an ink jet recording apparatus according to one embodiment of the invention.

An ink jet recording apparatus 240 shown in FIG. 11 has an ink jet head 241 which performs recording by use of a piezoelectric effect of a dielectric thin film element and expansion power of air bubble, and impacts ink droplets ejected from this ink jet head 241 onto a recording medium 242 such as paper thereby to perform recording on the recording medium 242.

In case that the line head is constituted by combination of the plural nozzle heads, by characteristic unevenness between the nozzle heads and accuracy of alignment onto the nozzle head holding frame, a streak appears in printing at a joint between the nozzle heads, so that printing quality lowers. Further, in case that the line head is constituted by combination of the plural nozzle heads, it is necessary to align the nozzle heads with a high accuracy. However, depending on accuracy of components, it is difficult to yield alignment accuracy.

In the ink jet recording apparatus 240 of this embodiment, which can perform color printing, on the ink jet head 241, a line head 243 having an ink head from which yellow ink is ejected, an ink head from which magenta ink is ejected, an ink head from which cyan ink is ejected, and an ink head from which black ink is ejected is mounted; and plural nozzle holes are arranged in each ink head throughout the entire width of the recording medium 42.

The ink jet recording apparatus 240 has plural rollers (moving means) 245 which move the recording medium 242 in a transporting direction that is almost perpendicular to a width direction of the ink jet head 241.

Though the color ink jet recording apparatus 240 is shown in this embodiment, the invention can be also applied to a monochromatic ink jet recording apparatus in which printing of only one color can be performed.

Figure 12:
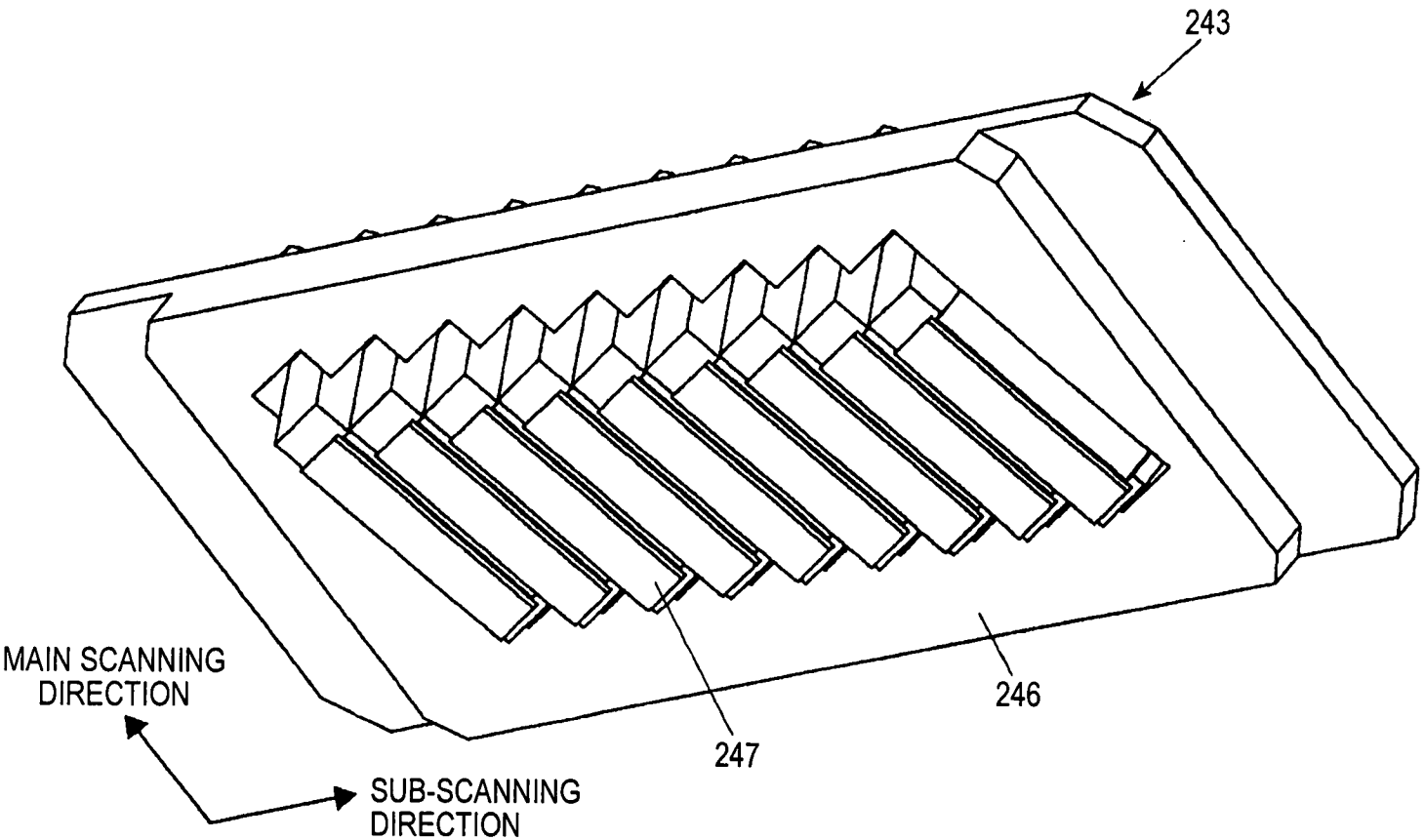
FIG. 12 is a perspective view showing a line head mounted on the ink jet recording apparatus of FIG. 11.

As shown in FIG. 12, the line head 243 includes a holding frame 246 and plural nozzle heads 247 arranged and fixed on this holding frame 246. In each nozzle head 247, plural nozzle holes (refer to FIG. 13 and below) 247*a* from which ink is ejected are formed. The plural nozzle heads 247 are arranged on the holding frame 246, whereby the nozzle holes 247*a* are arranged through the entire width of the recording medium 242.

In the ink jet head 241, plural pressure chambers in which ink liquid is filled are formed. By deforming the pressure chamber by an energy generating source such as a piezoelectric element or air bubbles, the ink is ejected from the nozzle hole 247*a* communicating with the pressure chamber.

Here, in order to achieve simultaneously size-reduction of the nozzle head 247 and improvement of printing resolution, it is important to arrange the nozzle holes 247*a* on the nozzle surface efficiently. In this embodiment, the nozzle holes 247*a* of the nozzle head are arranged at a high density as follows.

Figure 13:
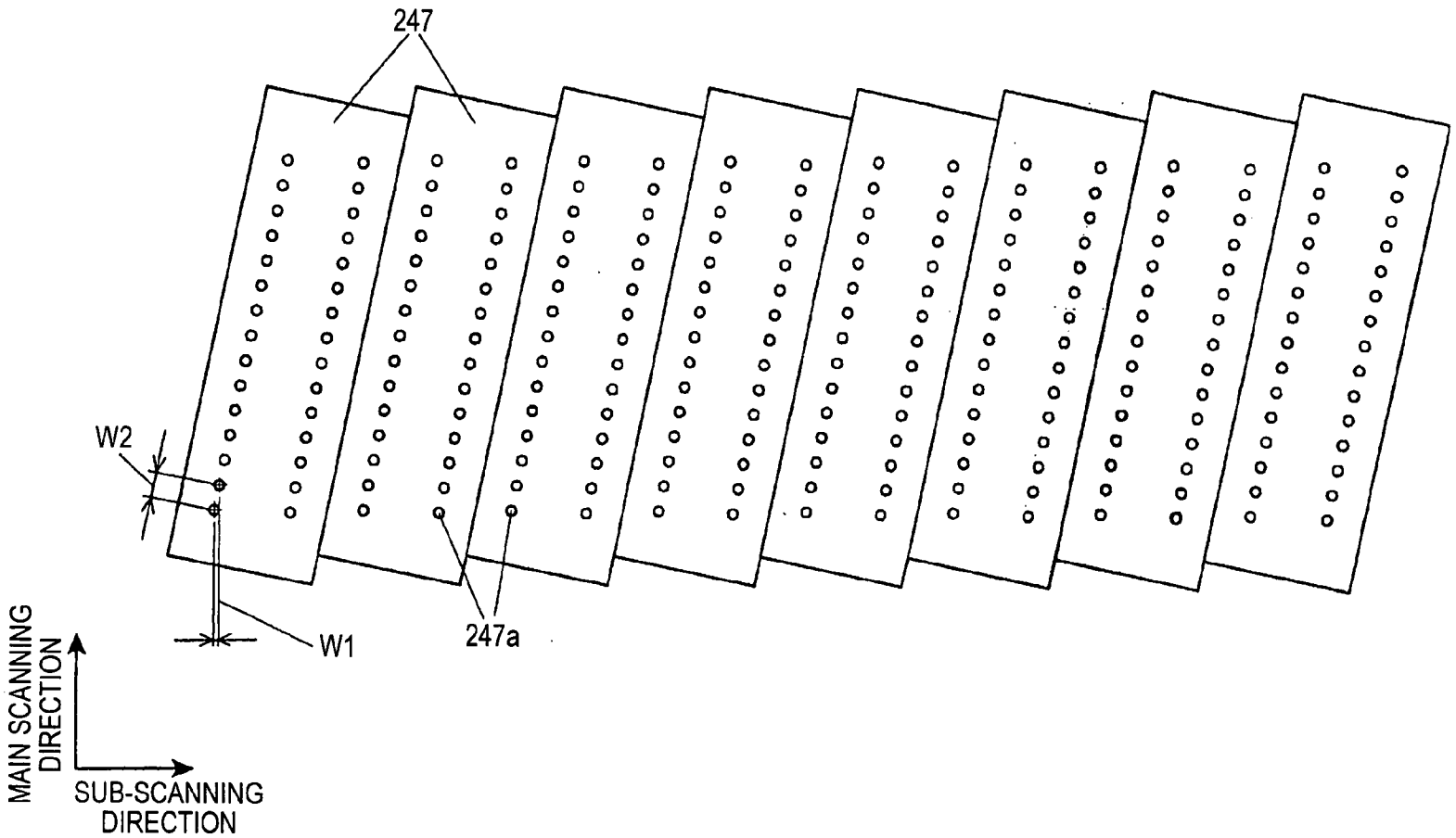
FIG. 13 is an explanatory view showing a line head in which a nozzle head according to one embodiment of the invention is used.

Namely, as shown in FIG. 13, in the nozzle head, plural nozzle arrays (two arrays in the embodiment) each of which comprises the plural nozzle holes 247*a* are arranged slantingly in the main scanning direction. The nozzle holes are arranged so that the distance between the nozzles between the adjacent nozzle arrays is not the same. Namely, the nozzle holes are arranged not with complete cross-stitch arrangement in which the distance between the adjacent nozzle arrays is equal but with cross-stitch arrangement in which the distance is different.

Figure 14:
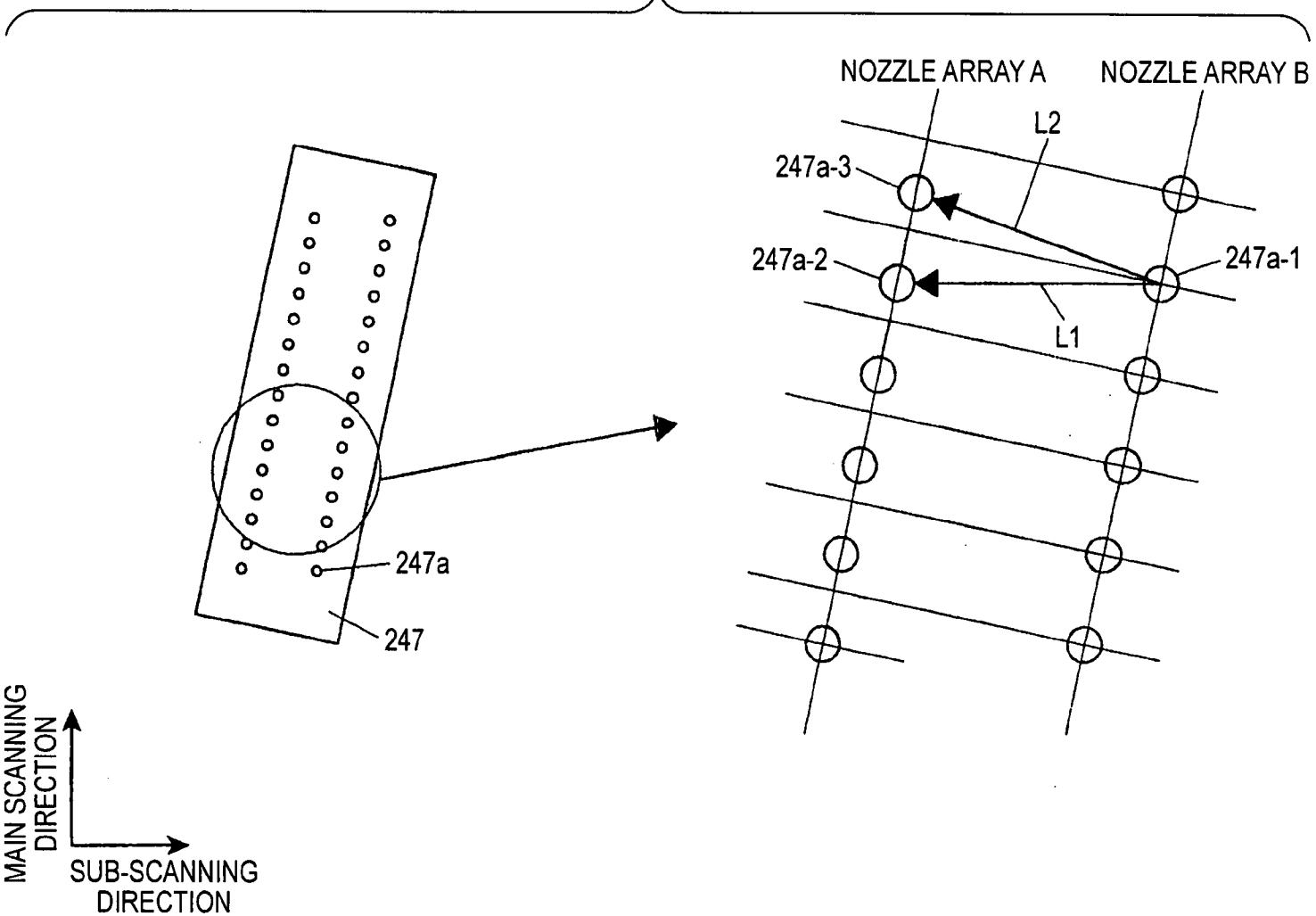
FIG. 14 is an explanatory view showing a main portion of FIG. 13.

More specifically, in FIG. 14, a distance L1 between a first arbitrary nozzle hole 247*a*-1 and a second nozzle hole 247*a*-2, in a nozzle array A adjacent to the array to which this first nozzle hole 247*a*-1 belongs, that is, the nozzle array B, which is adjacent to the first nozzle hole 247*a*-1, and a distance L2 between the first nozzle hole 247*a*-1 and a third nozzle hole 247*a*-3 in the nozzle array A to which the second nozzle hole 247*a*-2 belongs, which is further adjacent to the first nozzle hole 247*a*-1, are different from each other.

According to such the arrangement, as shown in FIG. 13, the nozzle head is scanned in the main scanning direction with a nozzle width W1 narrower than a nozzle width W2 in the sub-scanning direction, and the nozzles can be arranged in plural array arrangement with good space efficiency. Therefore, the improvement of printing resolution can be achieved, miniaturizing the nozzle head 247. Further, compared with a case where only one nozzle array is formed in the nozzle head, the distance to the nozzle end, which becomes a retreat region of a purge cap (not shown) and a mounting part can be used in common by the plural nozzle arrays.

Figure 15:
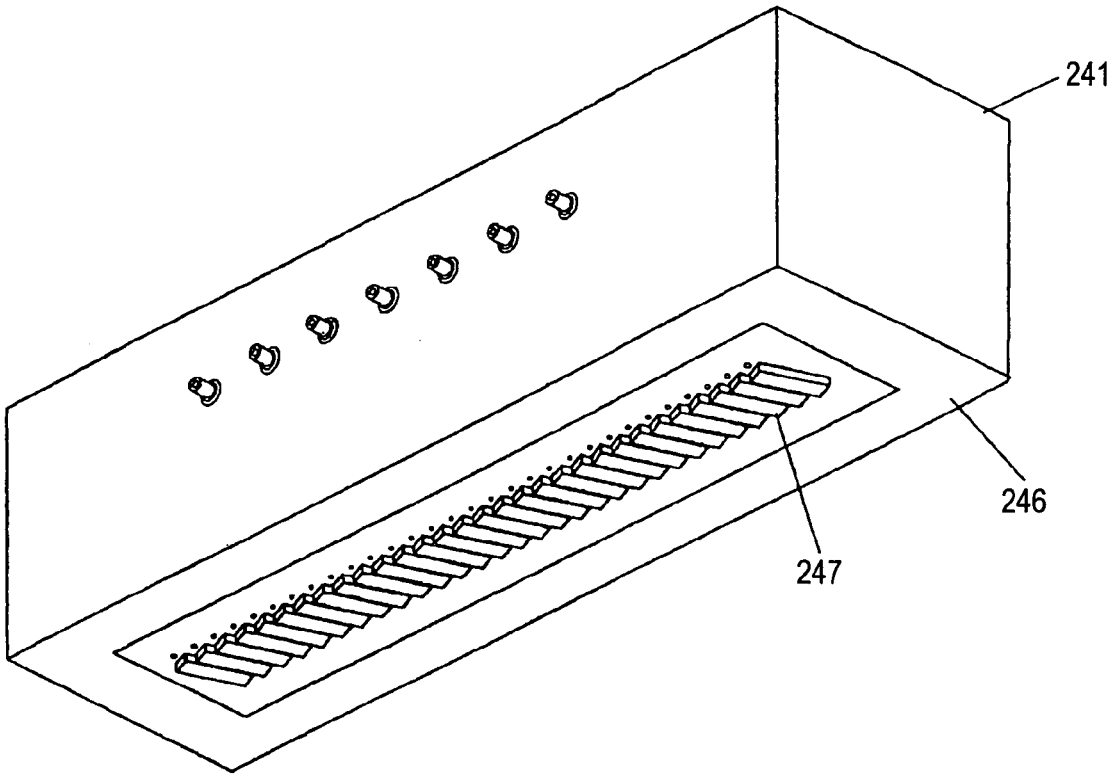
FIG. 15 is a perspective view of the ink-jet head according to Embodiment 1.
Figure 16:
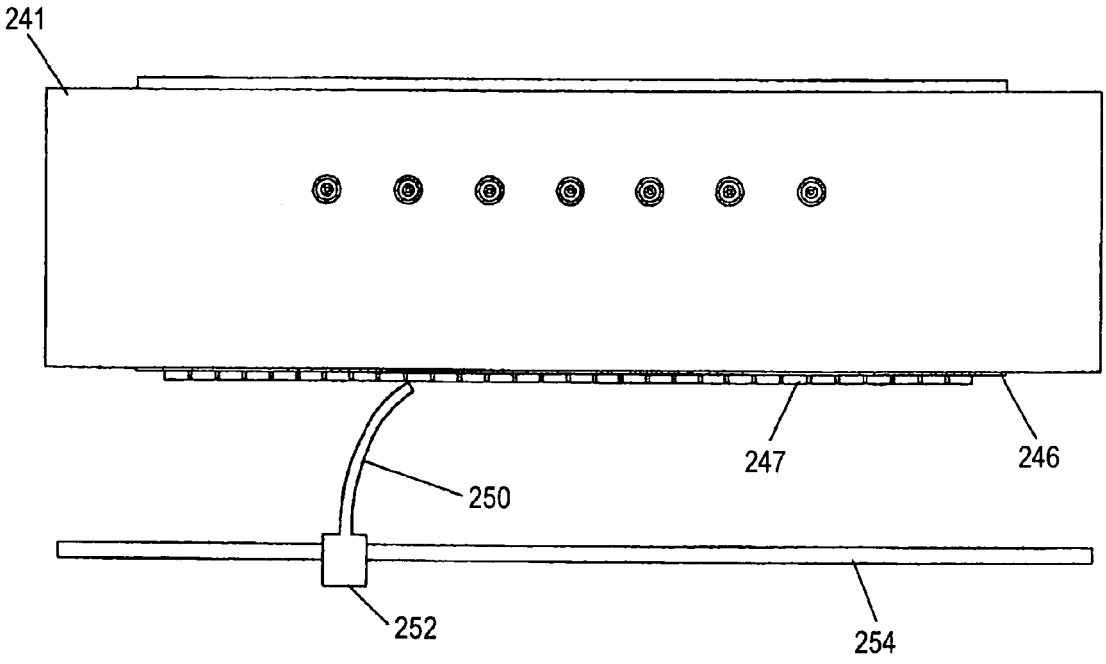
FIG. 16 is a front view of FIG. 15.
Figure 17:
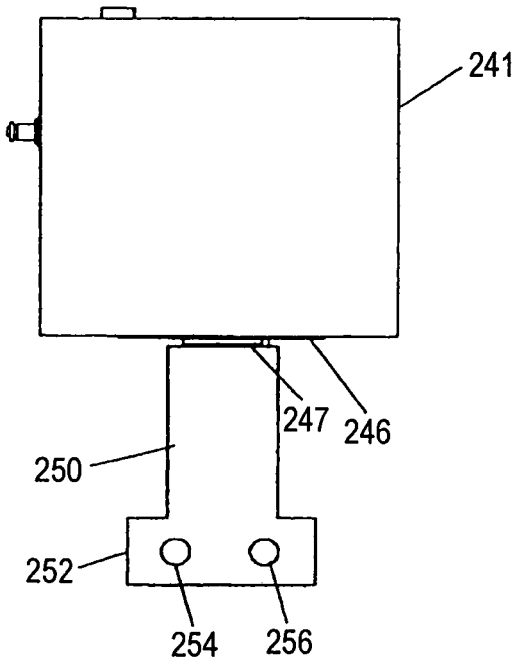
FIG. 17 is a side view of FIG. 15.

FIG. 15 is a perspective view of the ink-jet head 241 to which the line head 243 shown in FIG. 12 is assembled. FIGS. 16 and 17 are a front view and a side view of FIG. 15. As shown in FIG. 12 and FIGS. 15 to 17, the nozzle head 247 is projected about 4 mm from a surface of the holding frame 246. Excessive ink attached to a bottom face of the nozzle head 247 is removed by a cleaning blade 250 made of rubber, which is moved in a sub-scanning direction at a predetermined timing. Reason of why the nozzle head 247 is projected about 4 mm is as follow. When projection is too less, in case of that ink is collected at both end of the cleaning blade 250, the excessive ink may be touch with a surface of the holding frame 246. Contrary, when projection is too much, the cleaning blade 250 may be damaged by a corner of the nozzle head 247. It is not necessary to limit to the 4 mm projection if these two problems can be solved.

The excessive ink removed by the cleaning blade 250 is collected to a blade holding portion 252 by its gravity. The blade holding portion 252 is slidably held by the shafts 254 and 256, and is driven by not-illustrated motor in the sub-scanning direction.

According to the embodiment, because the nozzle head 247 is projected from a surface of the holding frame 246, even if the ink is collected at both ends of the cleaning blade 250 when the cleaning blade 250 squeegee the excessive ink attached with bottom face of the nozzle head 247, the excessive ink will not touch the surface of the holding frame 246. Thus, the printing degrade due to the ink adhered to the surface of the holding frame 246 is adhered to the printing media 242 can be prevented.

Example 2

Figure 18:
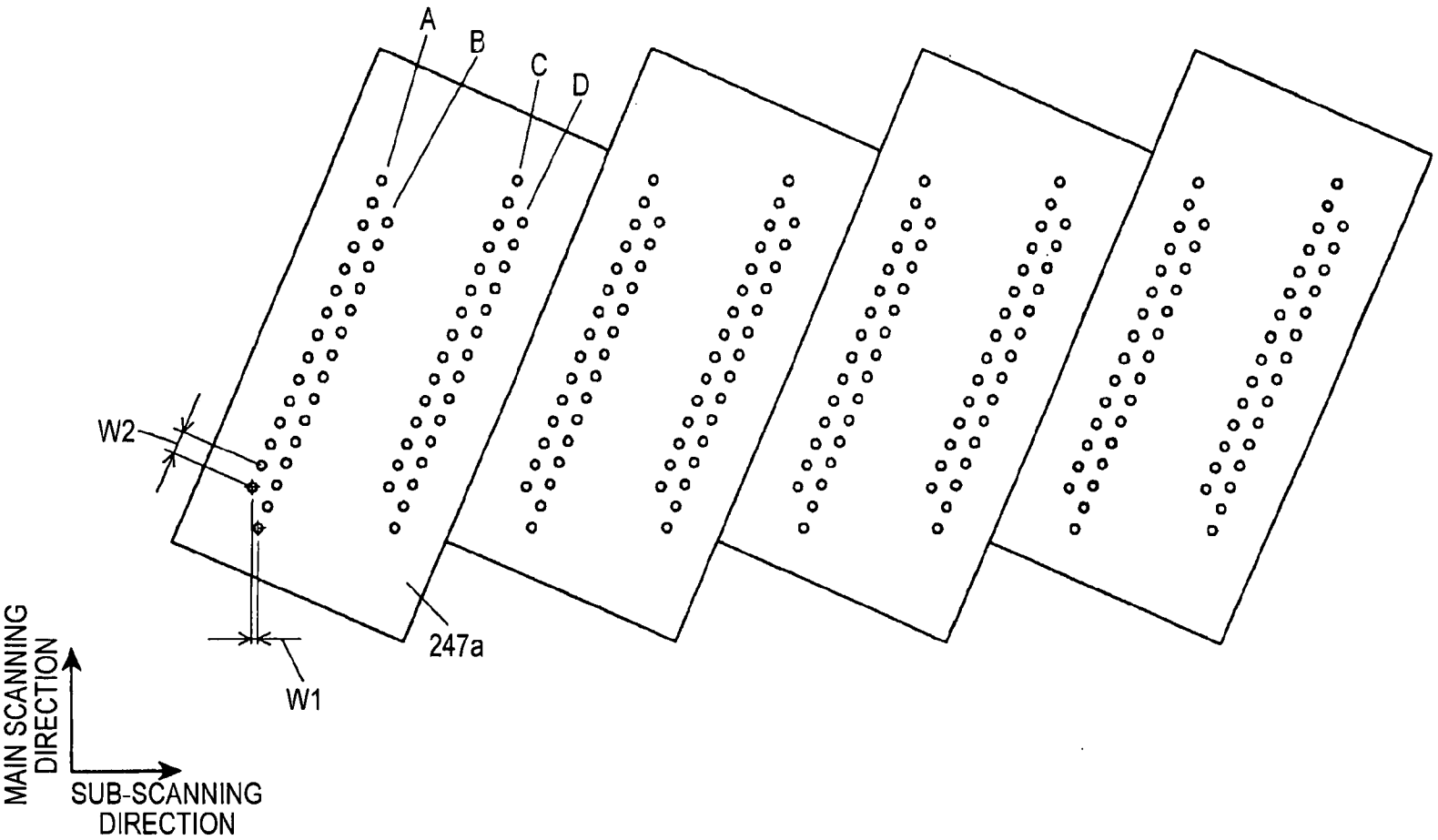
FIG. 18 is an explanatory view showing a line head in which a nozzle head according to another embodiment of the invention is used.

Here, in order to arrange the nozzle holes 247*a* with better space efficiency and prevent occurrence of the aforesaid warp of the nozzle plate, as shown in FIG. 18, the nozzle arrays of even numbers which are four and more are formed so that a distance between a set of nozzle arrays adjacent to each other becomes close, that is, so that the nozzle arrays come close to each other two by two. For example, as shown in FIG. 18, in case that there are the four nozzle arrays of A to D, they are arranged so that the distance between the A array and the B array or the distance between the C array and the D array is closer than the distance between the B array and the C array.

Example 3

Figure 19:
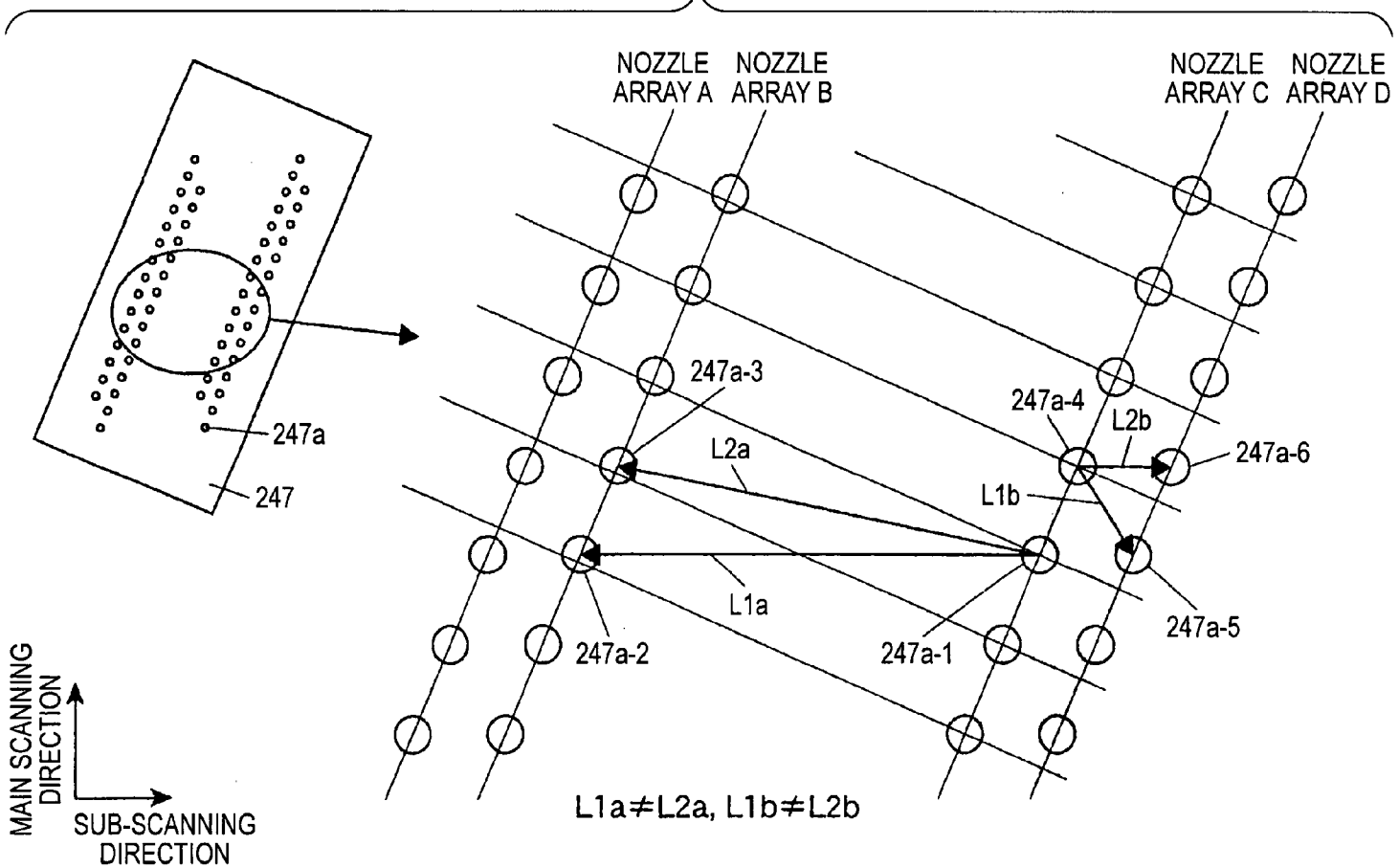
FIG. 19 is an explanatory view showing a line head in which a nozzle head according to another embodiment of the invention is used.

Further, there is another arrangement as shown in FIG. 19. Namely, a distance L1*a* between a first arbitrary nozzle hole 247*a*-1 formed in the nozzle array C and a second nozzle hole 247*a*-2 in the nozzle array B that is one of arrays adjacent to the nozzle array to which this first nozzle hole 247*a*-1 belongs, that is, the nozzle array C, which is adjacent to the first nozzle hole 247*a*-1, and a distance L2*a* between the first nozzle hole 247*a*-1 and a third nozzle hole 247*a*-3 in the nozzle array B to which the second nozzle hole 247*a*-2 belongs, which is further adjacent to the first nozzle hole 247*a*-1 are different from each other. Further, a distance L1*b* between a fourth arbitrary nozzle hole 247*a*-4 formed in the nozzle array C and a fifth nozzle hole 247*a*-5, in the nozzle array D that is the other of arrays adjacent to the nozzle array to which this fourth nozzle hole 247*a*-4 belongs, that is, the nozzle array C, which is adjacent to the fourth nozzle hole 247*a*-4, and a distance L2*b* between the fourth nozzle hole 247*a*-4 and a sixth nozzle hole 247*a*-6, in the nozzle array D to which the fifth nozzle hole 247*a*-5 belongs, which is further adjacent to the fourth nozzle hole 247*a*-4 are different from each other.

Hereby, the nozzle holes 247*a* are formed densely in the narrow region on the nozzle surface, so that the space efficiency can be more improved. Further, since the area of a region where the nozzle holes are not formed becomes large, rigidity of the nozzle plate improves and the occurrence of warp is prevented.

Example 4

Supporting that the number of nozzle arrays is plural, for example, four, in case that the nozzle arrays are arranged in order of A+B, and C+D in the sub-scanning direction, there can be a problem of a joint between the arrays A+B and the arrays C+D. Namely, due to working accuracy of the nozzle plate and attachment shift (rotation shift) of the head, a gap can be produced in the main scanning direction between a printing region by the nozzles in the arrays A+B and a printing region by the nozzles in the arrays C+D. Further, generally, in one nozzle array, abnormality (bad ejection of ink) is easy to be produced in the nozzle hole 247*a* located at the end because dust and an air bubble drift and attach to its nozzle hole 247*a*.

Figure 20:
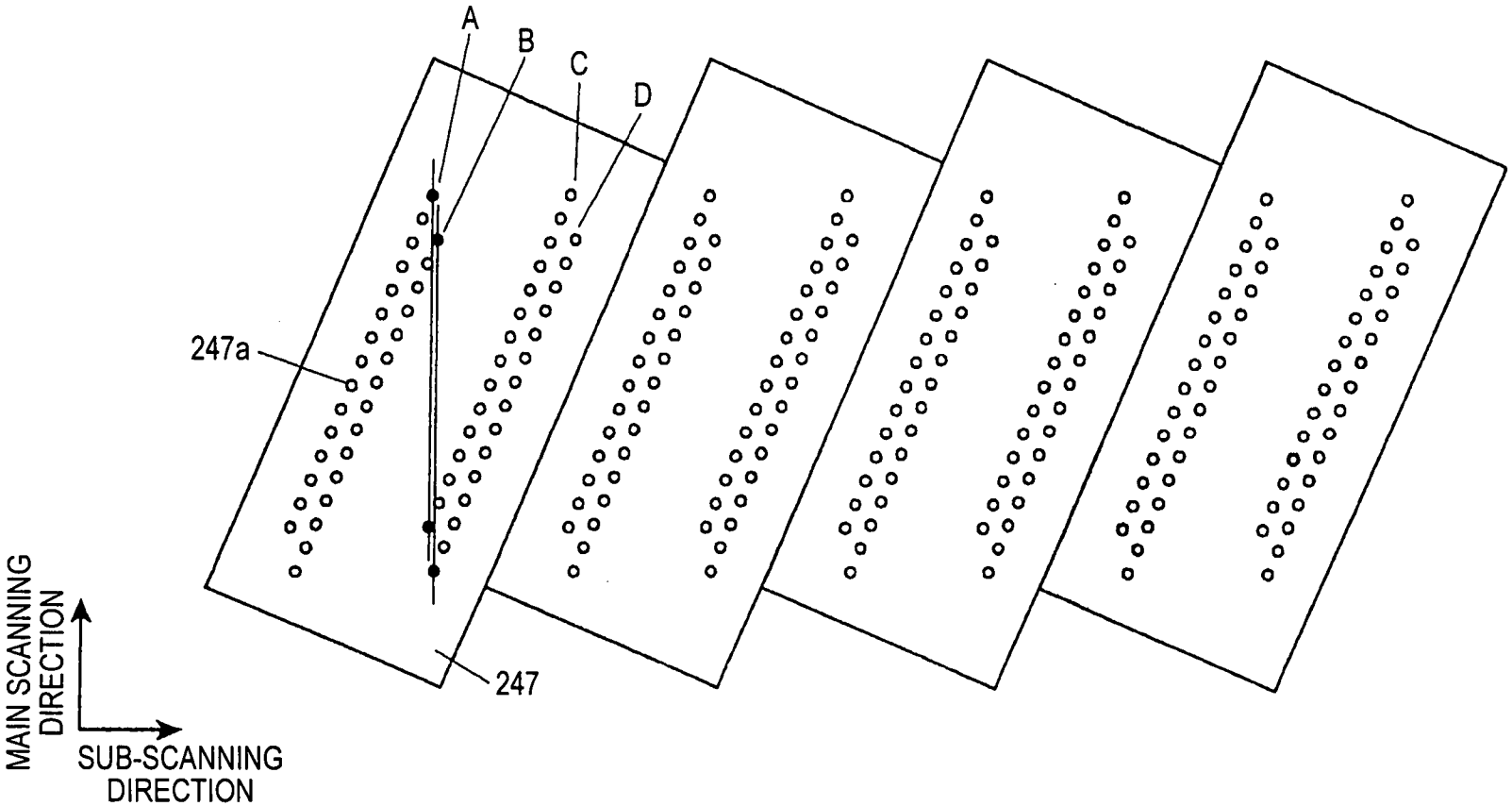
FIG. 20 is an explanatory view showing a line head in which a nozzle head according to another embodiment of the invention is used.

Therefore, as shown in FIG. 20, the nozzle holes are arranged so that the nozzle holes 247*a* located at one end of the nozzle arrays (here, A array and B array) overlap with the nozzle holes 247*a* located at the other end of the other arrays (here, C array and D array) in the sub-scanning direction.

By such the arrangement, since the same line can be printed with ink ejected from the plural nozzle holes 247*a*, pseudo-scanning of plural times is performed, so that a portion where the joint readily appears can be made inconspicuous, and the nozzle hole 247*a* from which the ink has not been already ejected can be recovered.

Herein, though the nozzle holes are arranged so that the nozzle hole 247*a* located at one end of the nozzle array overlaps with the nozzle hole 247*a* located at the other end of the other array in a sub-scanning direction, the nozzle holes 247*a* located at the both ends may be arranged thus. Further, the nozzle holes may be arranged so that not only the nozzle hole 247*a* located at the end but also a part or all of the nozzle holes 247*a* other than its nozzle hole overlaps with the nozzle hole 247*a* in another array in the sub-scanning direction.

In case that the nozzle holes 247*a* are thus arranged, the ink ejection in the sub-scanning direction may be performed alternately or irregularly from the nozzle holes 247*a* overlapping to each other in the sub-scanning direction. Hereby, since the same line or lines in the vicinity of its line can be printed with the ink ejected from the plural nozzle holes, the portion where the joint readily appears can be made inconspicuous, and the nozzle hole 247*a* from which the ink has not been already ejected can be recovered.

Here, as described before, in the edge shoot type in which only one nozzle array is formed per a nozzle head, usually, the nozzle holes 247*a* cannot be arranged at a high density, so that the space efficiency is not good. Therefore, in a case that the above-described plural nozzle heads are arranged and fixed on the holding frame so that the nozzle arrays tilt in the main scanning direction thereby to manufacture a line head, the resolution in the sub-scanning direction that is particularly important for the line head can be readily increased.

Example 5

In case that the line head comprises the plural nozzle heads, supporting that the number of nozzle arrays is, for example, four, in case that C+D nozzle arrays in one nozzle head and next A+B nozzle arrays in a nozzle head adjacent to its nozzle head are arranged, there can be a problem of a joint between the arrays C+D and the arrays A+B. Namely, due to working accuracy of the nozzle plate and attachment shift (rotation shift) of the head, a gap can be produced in the main scanning direction between a printing region by the nozzles in the arrays C+D and a printing region by the nozzles in the arrays A+B. Further, as described before, generally, in one nozzle array, the abnormality (bad ejection of ink) is easy to be produced in the nozzle hole 247*a* located at the end because dust and an air bubble drift and attach to the nozzle hole 247*a*.

Figure 21:
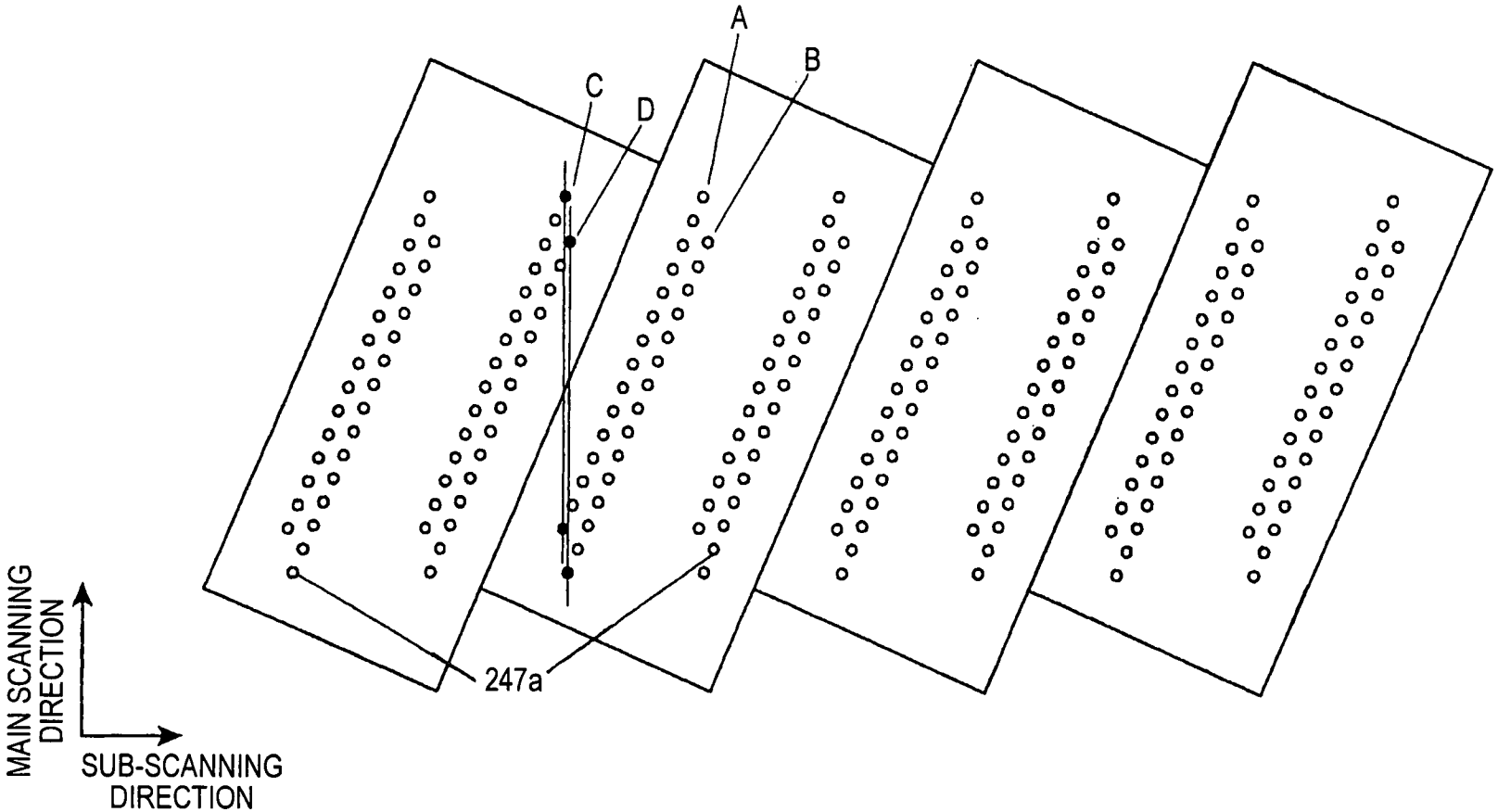
FIG. 21 is an explanatory view showing a line head in which a nozzle head according to another embodiment of the invention is used.

Therefore, as shown in FIG. 21, the nozzle holes are arranged so that the nozzle holes 247*a* located at one end of the nozzle arrays (here, C array and D array) of one nozzle head 247 overlap with the nozzle holes 247*a* located at the other end of the nozzle arrays (here, A array and B array) of a nozzle head adjacent to this nozzle head 247 in the sub-scanning direction.

By such the arrangement, since the same line can be printed with ink ejected from the plural nozzle holes 247*a*, pseudo-scanning of plural times is performed, so that the portion where the joint between the nozzle heads readily appears can be made inconspicuous, and the nozzle hole 247*a* from which the ink has not been already ejected can be recovered.

Herein, though the nozzle holes are arranged so that the nozzle hole 247*a* located at one end of the nozzle array of one nozzle head 247 overlaps with the nozzle hole 247*a* located at the end of the nozzle array of another nozzle head in the sub-scanning direction, the nozzle holes 247*a* located at the both ends may be arranged thus. Further, the nozzle holes may be arranged so that not only the nozzle hole 247*a* located at the end but also a part or all of the nozzle holes 247*a* other than its nozzle hole overlaps with the nozzle hole 247*a* of another array in the sub-scanning direction.

Figure 22:
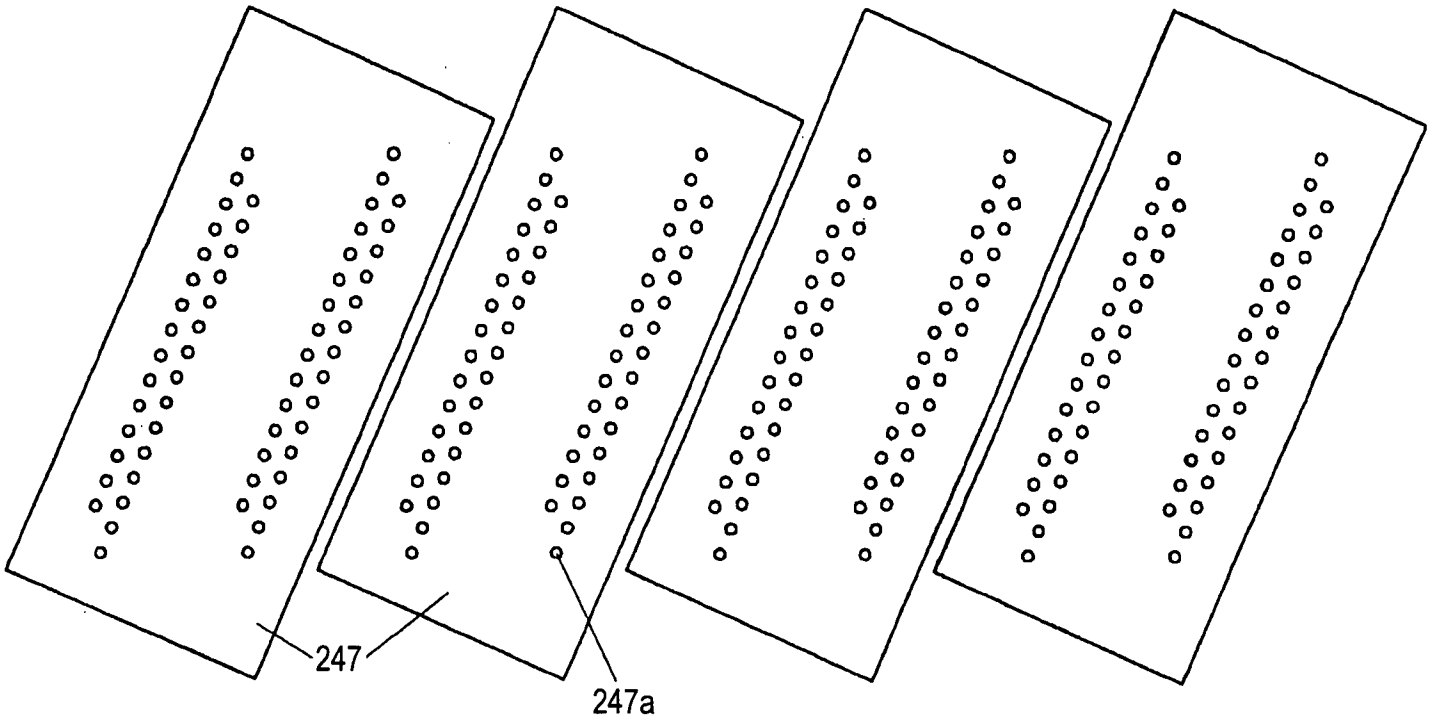
FIG. 22 is an explanatory view showing a line head in which a nozzle head according to another embodiment of the invention is used.

Here, in case that accuracy of the nozzle head 247 is not good when the nozzle heads 247 adjacent to each other are attached closely, the position of the nozzle hole 247*a* is different, so that alignment accuracy does not appear. Therefore, as shown in FIG. 22, in case that a gap is provided between the adjacent nozzle heads 247, fine adjustment of the head position of the nozzle head 247 is possible, so that a line head in which the nozzle heads 247 are aligned with a high accuracy can be obtained.

Due to scattering of ink in printing, or purge or blade operation, the ink enters in the gap between the nozzle heads 247, so that the gap between the heads can be covered with a film, that is, the gap can be bridged by the film. In case that the amount of this ink increases, a large ink droplet drops on the recording medium and the recording medium can be stained with this ink droplet.

Figure 23:
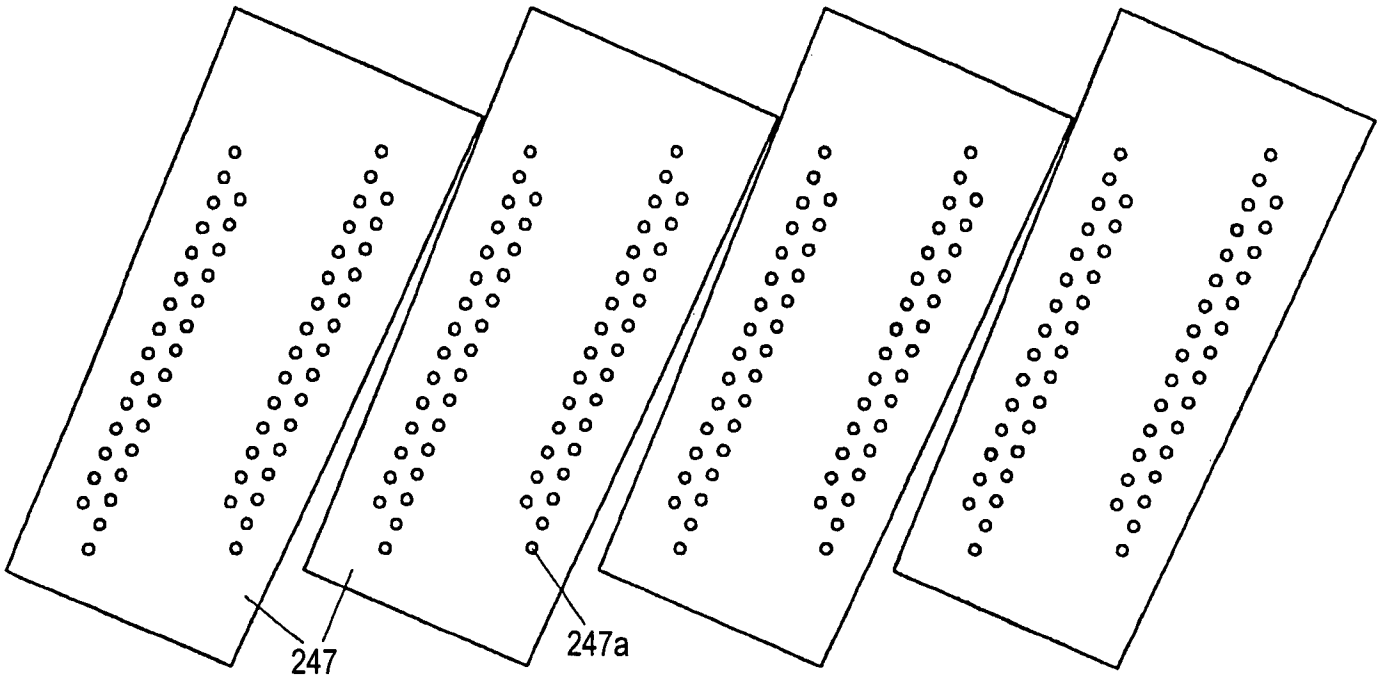
FIG. 23 is an explanatory view showing a line head in which a nozzle head according to another embodiment of the invention is used.

Therefore, as shown in FIG. 23, by forming the gap by the nozzle heads 247 so that its width becomes narrower from one side to the other side, the ink in the gap gathers and ink removal becomes easy, so that it is prevented that the ink that has entered in the gap between the nozzle heads 247 drops on the recording medium.

Fourth Embodiment

Embodiments of the invention will be described below with reference to FIGS. 24 to 36. In these drawings, the same members are denoted by the same reference numerals, and the overlapping description is omitted.

Figure 24:
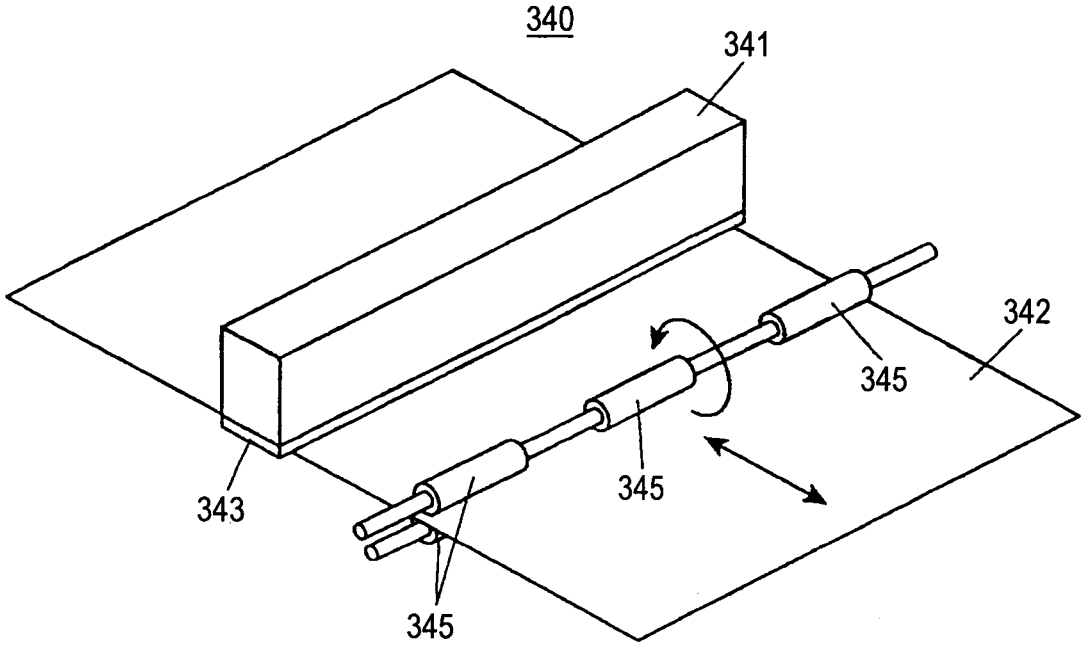
FIG. 24 is a schematic diagram showing an ink jet recording apparatus according to one embodiment of the invention.

An ink jet recording apparatus 340 shown in FIG. 24 has an ink jet head 341 which performs recording by use of a piezoelectric effect of a dielectric thin film element and expansion power of air bubble, and impacts ink droplets ejected from this ink jet head 341 onto a recording medium 342 such as paper thereby to perform recording on the recording medium 342.

In the ink jet recording apparatus 340 of this embodiment, which can perform color printing, on the ink jet head 341, a line head 343 having an ink head from which yellow ink is ejected, an ink head from which magenta ink is ejected, an ink head from which cyan ink is ejected, and an ink head from which black ink is ejected is mounted; and plural nozzle holes are arranged in each ink head throughout the entire width of the recording medium 342.

The ink jet recording apparatus 340 has plural rollers (moving means) 345 which move the recording medium 342 in a transporting direction that is almost perpendicular to a width direction of the ink jet head 341.

Though the color ink jet recording apparatus 340 is shown in this embodiment, the invention can be also applied to a monochromatic ink jet recording apparatus in which printing of only one color can be performed.

Figure 25:
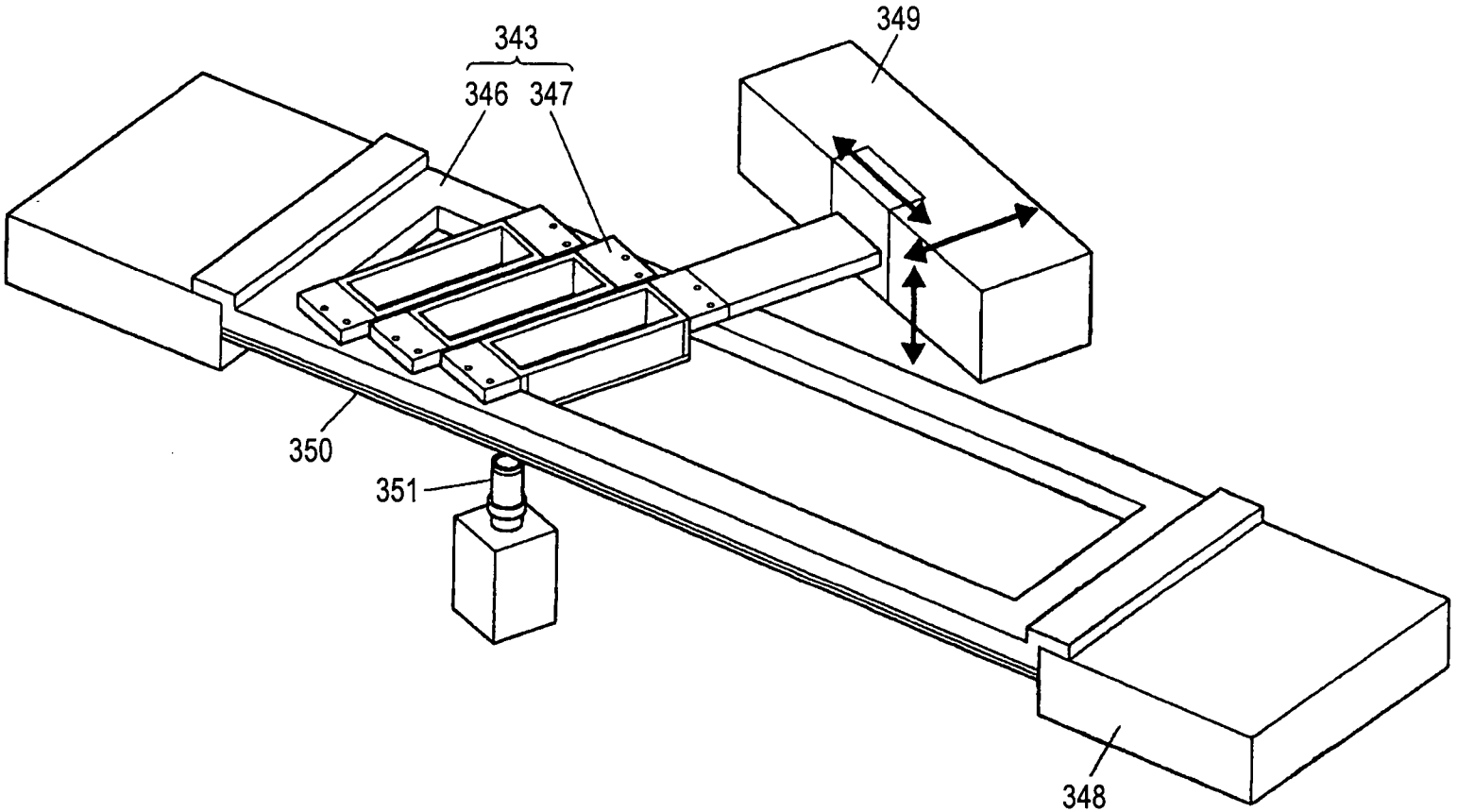
FIG. 25 is a perspective view showing a part of an alignment process in a line head mounted on the ink jet recording apparatus of FIG. 24.

As shown in FIG. 25, the line head 343 includes a holding frame 346 and plural nozzle heads 347 arranged and fixed on this holding frame 346. In each nozzle head 347, plural nozzle holes (not shown) from which ink is ejected are formed. Such the plural nozzle heads are arranged on the holding frame 346, whereby the nozzle holes are arranged through the entire width of the recording medium 342.

In this embodiment, the plural nozzle heads 347 are aligned with a high accuracy by the following method and fixed onto the holding frame 346, whereby the ink ejecting direction is made uniform among the nozzle heads 347 and high quality printing is made possible.

Figure 26:
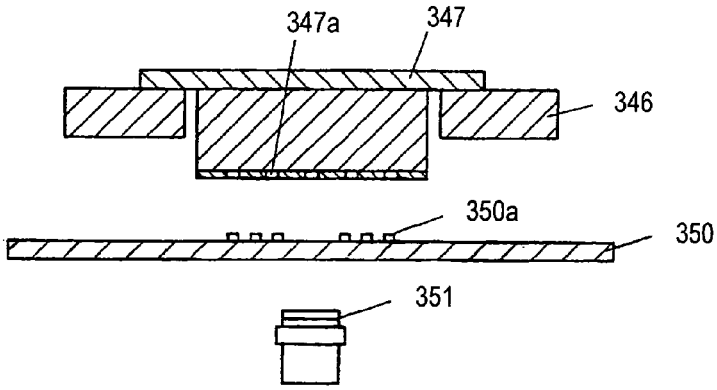
FIG. 26 is a sectional view of FIG. 25.

Namely, in FIGS. 25 and 26, the holding frame 346 is held at its both sides by a frame holding unit 348, and a positional relation between them is fixed. By this frame holding unit 348, a transparent plate 350 on which an alignment mark 350*a* is formed is held along the holding frame 360.

The nozzle head 347 in which many nozzle holes 347*a* are provided is held by a head holding unit 349 which can move this nozzle head 347 in a horizontal direction and in a vertical direction. The plate 350 and the nozzle head 347 are opposed to each other to observe the nozzle head 347 through the transparent plate 350 by a camera means 351, and registration is performed between the alignment mark 350*a* of the plate 350 and the predetermined position (for example, nozzle hole 347*a* or nozzle mark 347*b* formed for alignment) of the nozzle head 347 on the basis of the alignment mark 350*a*, whereby alignment of the nozzle heads 347 is performed. After the alignment, the nozzle head 347*s* are fixed onto the holding frame 346.

In FIG. 25, though the nozzle head 347 is fixed onto the holding frame 346 slantingly, it may be fixed in parallel.

Figure 27:
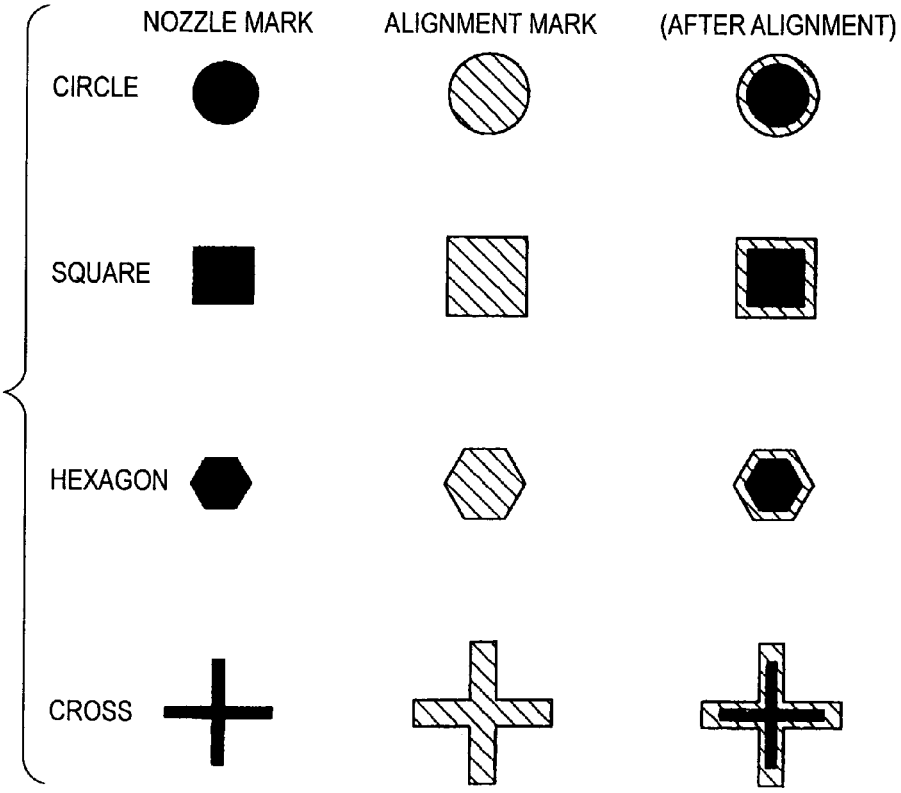
FIG. 27 is an explanatory view in alignment of the line head of FIG. 25, showing one example of a nozzle mark formed on a nozzle head and an alignment mark formed on a plate.

Here, as an example of the marks, shapes of a nozzle mark of the nozzle head 347 and shapes of the alignment mark 350*a* of the plate 350 are shown in FIG. 27. As shown in FIG. 27, the nozzle mark and the alignment mark 350*a* overlap each other. The shown shapes are one example, and the invention is not limited to these shapes. In FIG. 27, though the mark of the plate 350 is larger than the mark of the nozzle head 347, they may have the same size or the mark of the nozzle head 347 may be larger.

By performing such the alignment in order, the plural nozzle heads 347 can be aligned easily and with a high accuracy.

It is preferable that the plate 350 is made of not resin such as plastics but glass. Namely, a material used as the plate 350 must be able to be used as gauge, that is, it must be small in expansion coefficient in relation to the temperature. The glass meets this condition. Further, since the glass itself having high smoothness is not a special material but cheap, the cost does not increase.

There is a case in which the many alignment marks 350*a* are required on the transparent plate 350. Though the alignment mark 350*a* may be formed by any work on the plate 350, this formation is difficult in accuracy and man-hour in order to form the many marks freely. In such the case, the alignment mark 50*a* is formed by sputtering of chromium (Cr), whereby the many alignment marks 350*a* can be readily formed because they can be formed by a usual method using a photo mask. Further, since accuracy of the photo mask is so accurate that position accuracy of the mark on the glass having the large area of 500 mm by 500 mm is ±2 μm, the alignment mark 50*a* can be formed at a low cost and with a good accuracy.

Further, as shown in FIG. 26, it is desirable that the alignment mark 350*a* is formed on an opposed surface of the plate 350 to the nozzle head 347. This reason is that: since index of refraction of the plate 350 is not 1, in case that the alignment mark 350*a* exists on the opposite side to the surface opposed to the nozzle head 347, the alignment mark 350*a* is directly seen and the nozzle head 347 is seen through the plate 350, so that deviation is produced. On the other hand, in case that the alignment mark 350*a* exists on the surface opposed to the nozzle head 347, both the alignment mark 350*a* and the nozzle head 347 are seen through the plate 350. Therefore, an influence by index of refraction of the plate 350 is small, and the distance between the alignment mark 350*a* and the nozzle head 347 becomes short, so that the alignment accuracy can be improved.

Figure 28:
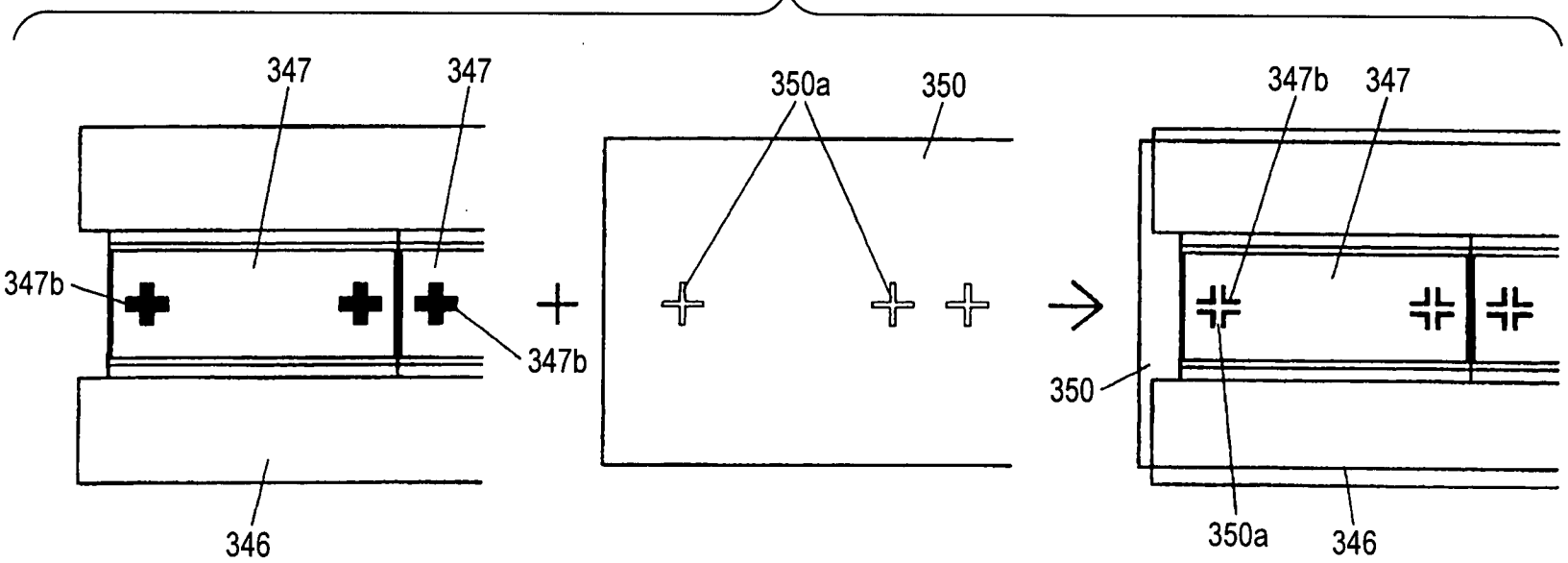
FIG. 28 is an explanatory view showing one example of an alignment method of nozzle heads.

Here, it is good that at least two, that is, plural alignment marks 350*a* are formed on one nozzle head 347. This reason is that: in case that the registration is performed by only one alignment mark 350*a*, there is fear of generation of rotational deviation, but in case that the alignment is performed by the plural alignment marks 350*a*, as shown in FIG. 28, the registration can be readily performed with the high accuracy.

Figure 29:
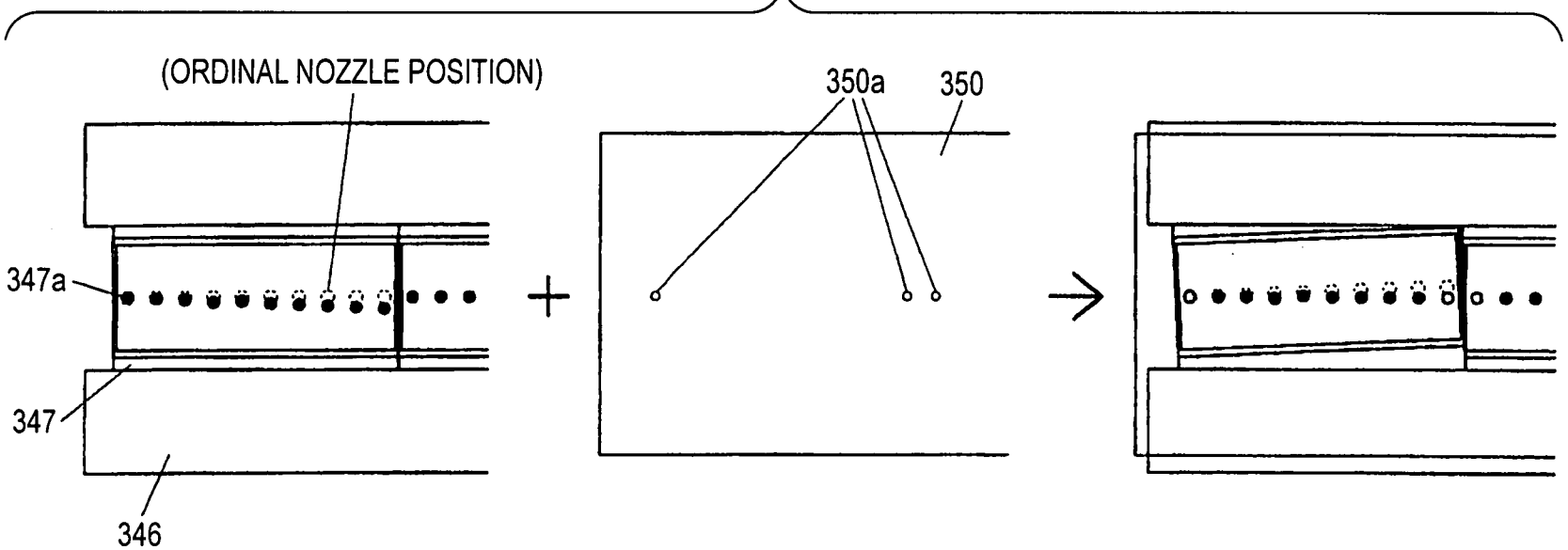
FIG. 29 is an explanatory view showing another example of the alignment method of nozzle heads.

Further, it is good that the registration is performed by the nozzle hole 347*a* of the nozzle head 347 and the alignment mark 350*a*. As a mark to be formed on the nozzle head 347 itself, a mark obtained by any previous work on the nozzle head 347 may be used. However, accuracy in the positional relation between its worked part and the nozzle hole 347*a* is not always insured. Further, though it is thought that the registration is performed at an edge portion of the nozzle head 347, accuracy in the positional relation between the edge part and the nozzle hole 347*a* is not also always insured. On the other hand, in case that the alignment is performed by the nozzle hole 347*a* and the alignment mark 350*a*, even if the nozzle hole 347*a* formed in the nozzle head 347 shifts from its natural position as shown in FIG. 29, the alignment can be performed in a correct nozzle position, so that an ink droplet can be impacted onto a correct position.

Figure 30:
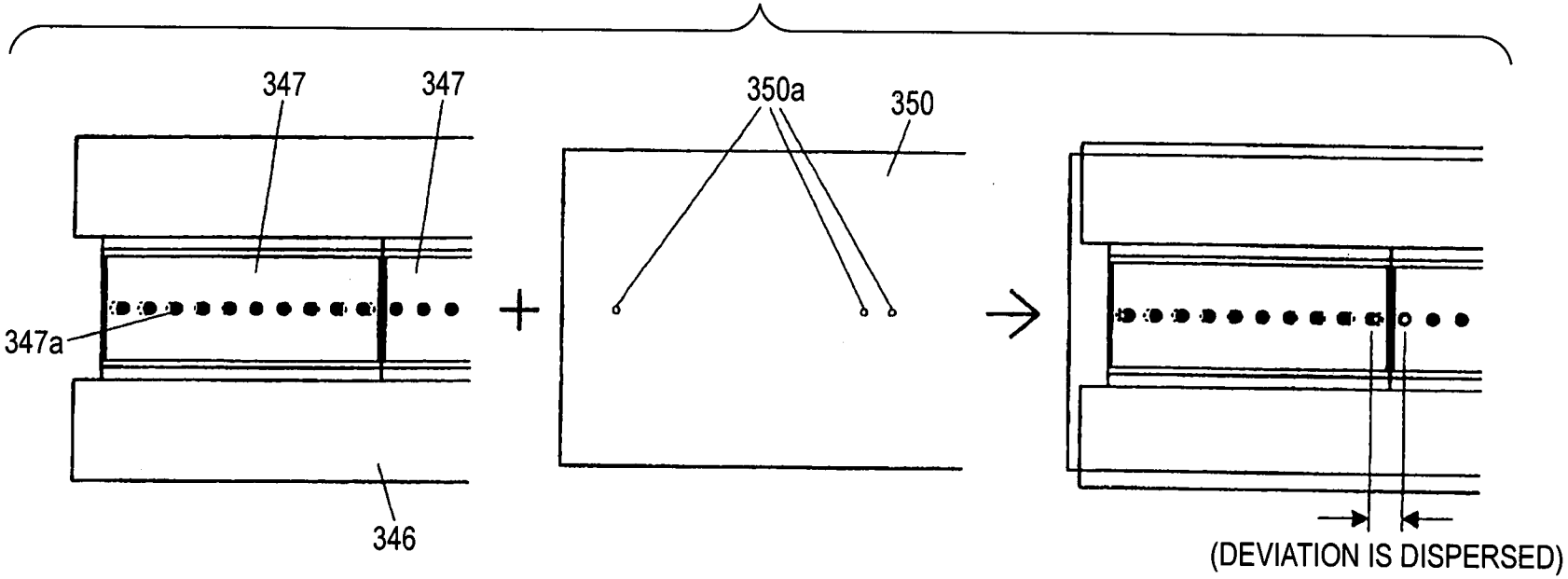
FIG. 30 is an explanatory view showing another example of the alignment method of nozzle heads.

Here, it is good that the registration between the plate 350 and the nozzle head 347 is performed in the center of the plural alignment marks 350*a*. Since the nozzle hole 347*a* requires a complicated taper shape, the positional accuracy when the nozzle hole 347*a* is worked is inevitably inferior to that of the alignment mark 350*a* having a high accuracy. Hereby, a work of performing registration between members that do not completely coincide with each other in their position is required. Further, in case that the position of only one alignment mark 350*a* is coincided with that of the nozzle hole 347*a*, the registration error between the other alignment mark 350*a* and the nozzle hole 347*a* of the next nozzle head 347 is readily produced. On the other hand, in case that the registration between the plate 350 and the nozzle head 347 is performed in the center of the plural alignment marks 350*a*, as shown in FIG. 30, the deviation between the alignment mark 350*a* and the nozzle hole 347*a* is dispersed in two directions, so that deviation of impact in printing becomes inconspicuous.

Figure 31:
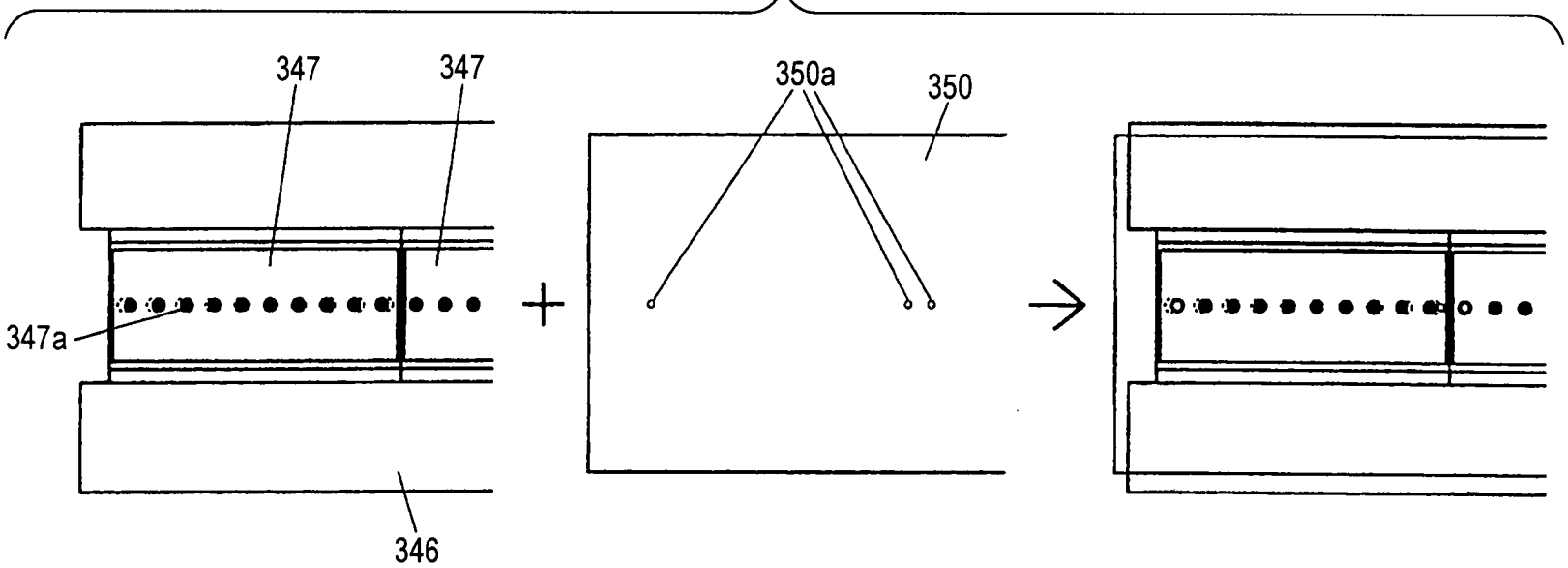
FIG. 31 is an explanatory view showing another example of the alignment method of nozzle heads.

It is desirable that the registration is performed between the nozzle holes 347*a* located at both ends of the nozzle head 347 and the alignment marks 350*a*. In case that the alignment is performed at the adjacent plural nozzle holes 347*a*, even if the deviation amount in relation the alignment mark 350*a* is the same, the whole deviation amount becomes large. However, in case that the registration is performed at the nozzle holes 347*a* located at the both ends as shown in FIG. 31, since the alignment marks 350*a* are distant from each other, the alignment accuracy becomes good. Further, since the alignment accuracy becomes good at end-pin parts, streaks between the adjacent nozzle heads become inconspicuous.

Figure 32:
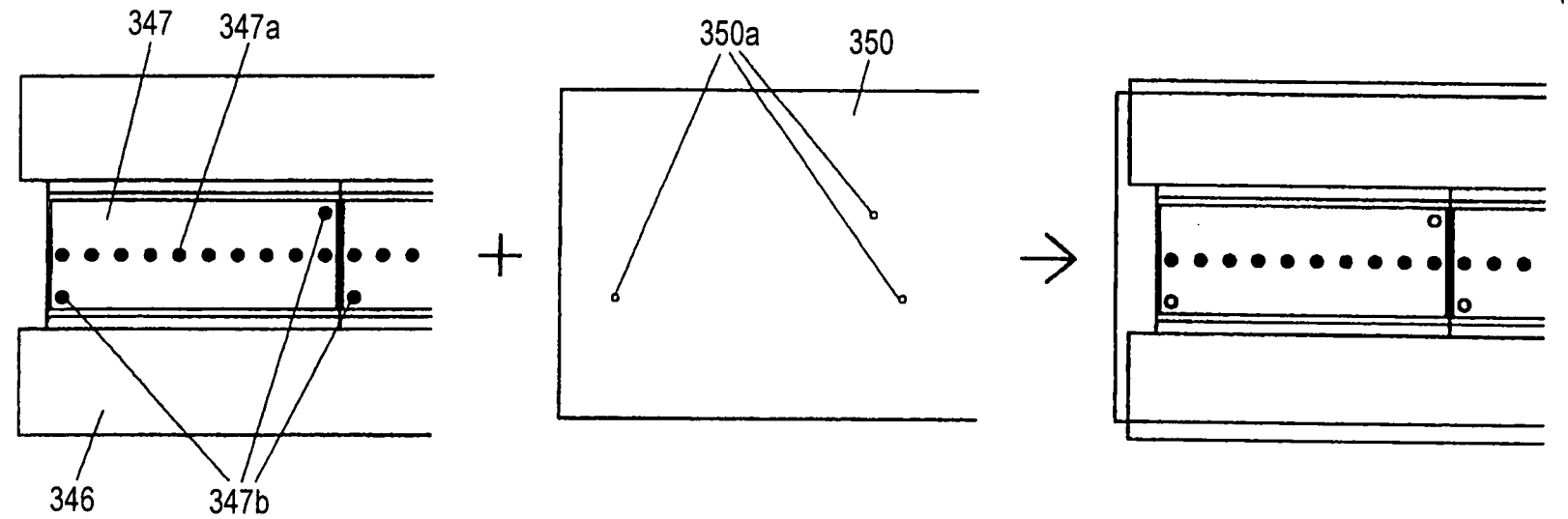
FIG. 32 is an explanatory view showing another example of the alignment method of nozzle heads.

Further, the registration may be performed by an alignment mark 350*a* and a nozzle mark 347*b* formed on the nozzle head 347 in the same process as the nozzle hole 347*a*. Namely, before the alignment process, in case that a filling examination and an ejection examination of ink liquid are performed in the nozzle head 347 single, a leading end of the nozzle hole 347*a* may get wet with the ink in the alignment, and a nozzle edge may become dim. In this case, using not the nozzle hole 347*a* used for ink ejection but a dummy nozzle hole worked in the same process as the nozzle hole 347*a*, that is, the nozzle mark 347*b*, as shown in FIG. 32, the alignment is performed. Hereby, since the nozzle mark 347*b* is formed in the same process as the nozzle hole 347*a*, the shape accuracy and the position accuracy are the same as those in the nozzle hole 347*a*. Therefore, the alignment of the high accuracy can be performed. In addition, since the nozzle mark 347*b* is not wetting with the ink, the nozzle edge is clear, so that the alignment is easy to be performed. Even if the nozzle mark 347*b* gets wet, since it is not used for the ink ejection, the ink can be wiped to solve the wet.

Figure 33:
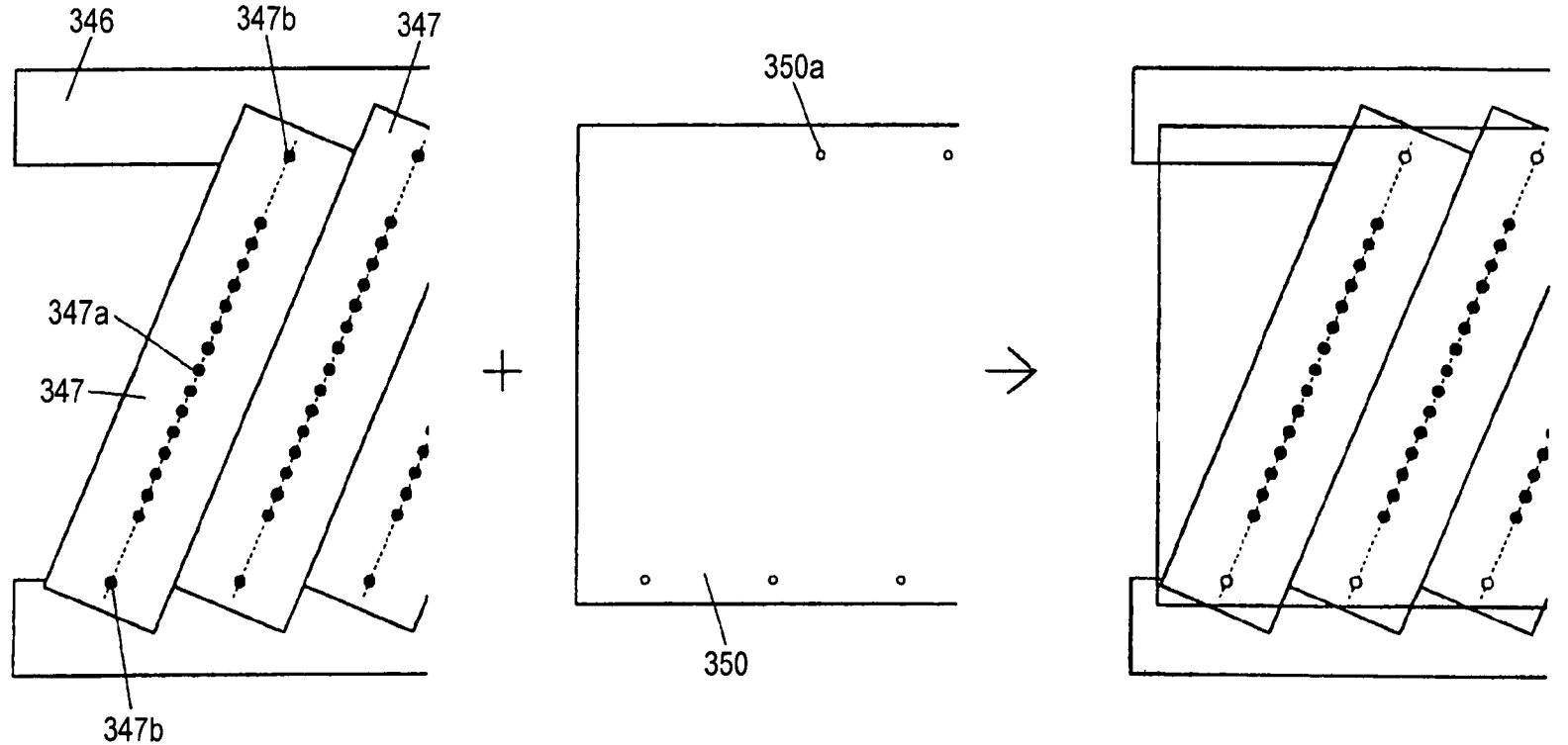
FIG. 33 is an explanatory view showing another example of the alignment method of nozzle heads.
Figure 34:
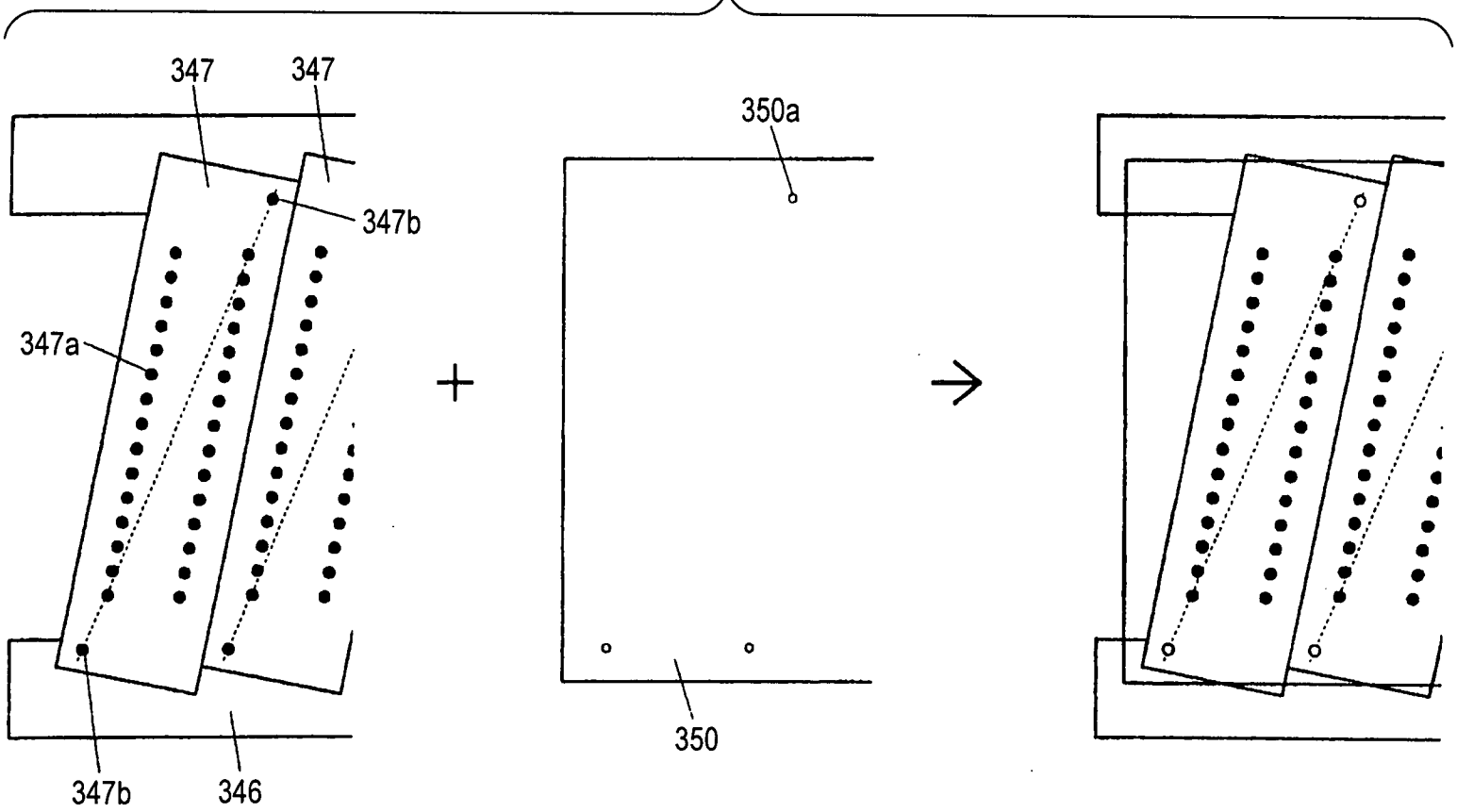
FIG. 34 is an explanatory view showing another example of the alignment method of nozzle heads.

Further, the registration may be performed by an alignment mark 350*a* and a nozzle mark 347*b* formed on a line connecting two nozzle holes 347*a* located at both ends of the nozzle head 347. Hereby, the alignment can be performed with the same accuracy as the accuracy in a case that the registration is performed at the nozzle holes 347*a* located at the endmost, or with higher accuracy in case that the distance between the nozzle marks 347*b* is farther than the distance between the nozzle holes 347*a* located at the endmost. Such the registration is particularly effective when the nozzle head 347 is arranged on the holding frame 46 slantingly. Here, the two nozzle holes 347*a* located at the both ends of the nozzle head 347 may be, as shown in FIG. 33, two nozzle holes 347*a* located at the both ends in one nozzle array; or, as shown in FIG. 34, two nozzle holes 347*a* located at ends different from each other in two adjacent or most distant nozzle arrays.

Figure 35A:
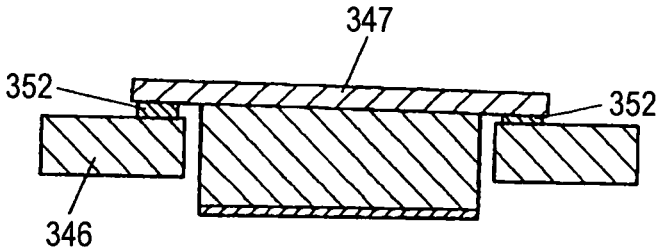
FIGS. 35A and 35B are explanatory views showing another example of the alignment method of nozzle heads.
Figure 35B:
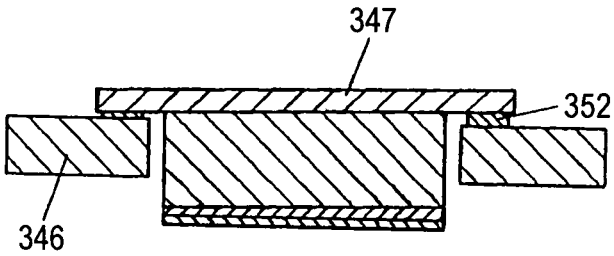

Even if the alignment is thus performed, in case that work accuracy of the nozzle head 347 is bad or the thickness of an adhesive when the nozzle plate is bonded is not uniform, the nozzle surfaces of the plural nozzle heads 347 are different in plane from each other. Namely, in case that deviation is produced in a Z-direction, the distance between the nozzle surface and the recording medium 342 is different in each nozzle head 347, or its distance has an inclination in the Z-direction, so that an impact position of the ink droplet is different in each nozzle head 347, and high quality printing is impossible. In such the case, as shown in FIG. 35, a spacer 352 may be arranged between the holding frame 346 and the nozzle head 347 to hold the nozzle surfaces of the plural nozzle heads 347 on the same plane. Hereby, surface accuracy of the nozzle surfaces of the plural nozzle heads 347 can be readily secured.

Figure 36:
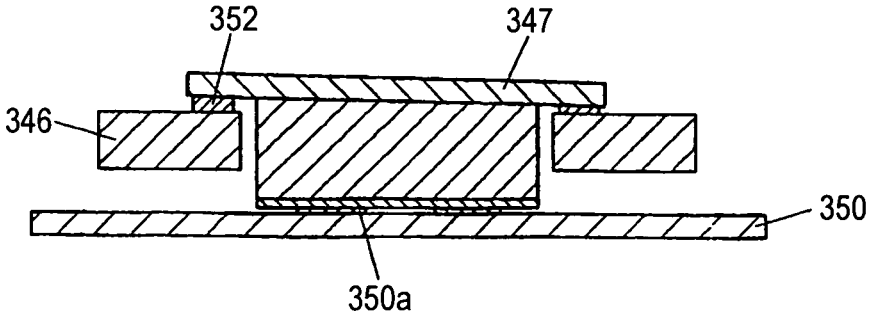
FIG. 36 is an explanatory view showing another example of the alignment method of nozzle heads.

In order to adjust the nozzle heads 347 so that the nozzle surfaces of the plural nozzle heads 347 are located on the same plane, as shown in FIG. 36, the nozzle heads 347 are closely attached onto the plate 350, whereby, this adjustment can be readily performed.

As understandable from the description, the above described various embodiments may be combined each others to attain its function.

As described above, according to the invention, since the mounted part is formed in the position between the nozzle arrays, the nozzle hole which is comparatively difficult to receive the influence caused by the weak close attachment power of the thin films constituting the head can be formed at the side portion of the head, so that the mounted part and the nozzle arrays can be arranged on the head efficiently. Therefore, an effective advantage that the dead space is eliminated and the head can be miniaturized can be obtained.

Further, since the mounted part is formed in the position between the nozzle arrays, even in case that the flat cable is arranged within the width of the head in the direction orthogonal to the surface of the flat cable, along the head base, the flat cable can be bent with such the comparatively large curvature that breaking of wire can be prevented, so that an effective advantage that the flat cable can be pulled around compactly can be obtained.

According to the first aspect of the invention, an ink jet head unit comprises a head in which plural nozzle arrays of which each comprises many nozzle holes are formed, and ink is ejected from the nozzle holes; a head base on which the head is mounted; and a flat cable flexibly formed by covering many transmission wires with an insulation film, of which one end side where the transmission wires are exposed is fixed, in a mounted part interposed between the nozzle arrays, onto the head thereby to transmit an ink ejection signal for driving the head. Hereby, since the mounted part and the nozzle arrays can be arranged efficiently on the head, the dead space is eliminated, so that the head can be miniaturized. Further, even in case that the flat cable is arranged within a width of the head in a direction orthogonal to a surface of the flat cable, along the head base, the flat cable can be bent with such a comparatively large curvature that breaking of wire can be prevented, so that the flat cable can be pulled around compactly.

According to the second aspect of the invention, an ink jet head unit comprises a head in which a first nozzle array and a second nozzle array of which each comprises many nozzle holes are formed, and ink is ejected from the nozzle holes; a head base on which the head is mounted; and a flat cable flexibly formed by covering many transmission wires with an insulation film, of which one end side where the transmission wires are exposed is fixed, in a mounted part interposed between the first nozzle array and the second nozzle array, onto the head thereby to transmit an ink ejection signal for driving the head. Hereby, since the mounted part and the first and second nozzle arrays can be arranged efficiently on the head, the dead space is eliminated, so that the head can be miniaturized. Further, even in case that the flat cable is arranged within a width of the head in a direction orthogonal to a surface of the flat cable, along the head base, the flat cable can be bent with such a comparatively large curvature that breaking of wire can be prevented, so that the flat cable can be pulled around compactly.

According to the third aspect of the invention, in the ink jet head unit according to the first or second aspect, the flat cable is arranged, within a width of the head in a direction orthogonal to a surface of the flat cable, along the head base. Hereby, the flat cable can be pulled around compactly.

According to the fourth aspect of the invention, in the ink jet head unit according to any one of the first to third aspects, the number of the flat cables is plural, and they extend respectively from a fixed position of the head in the same direction or the different direction. Hereby, the flat cable can be pulled around compactly.

According to the fifth aspect of the invention, in the ink jet head unit according to the fourth aspect, a metallic interference preventing member or a nonmetallic interference preventing member in which a metal layer is formed is arranged at least at a part between the plural flat cables. Hereby, electromagnetic mutual interference between the flat cables is relaxed.

According to the sixth aspect of the invention, in the ink jet head unit according to the fourth or fifth aspect, the plural flat cables are arranged so that the transmission wires formed in these flat cables are nonparallel to each other. Hereby, electromagnetic mutual interference between the flat cables is relaxed.

According to the seventh aspect of the invention, in the ink jet head unit according to any one of the fourth to sixth aspects, drivers of which each generates an ink ejection signal for driving the head and includes a heat radiation plate are provided in midway positions of the plural flat cables; and these drivers are arranged so as to shift from each other. Hereby, since the plural drivers having heat during the operation are distant from each other, it is prevented that heat radiation efficiency of the respective heat radiation plates is lessened due to adjacency between the heat radiation plates.

According to the eighth aspect of the invention, in the ink jet head unit according to any one of the first to seventh aspects, a notch part into which the flat cable is fitted is formed on a side surface of the head base. Hereby, the flat cable can be compactly housed within the width of the head in the direction orthogonal to the surface of the flat cable.

According to the ninth aspect of the invention, in the ink jet head unit according to any one of the first to eighth aspects, the flat cable has at least two bending parts at its part extending from the head base. Hereby, since an extra length can be provided for the flat cable, work performance in assembly of the apparatus can be improved by adjusting the forming positions of the bending parts.

According to the tenth aspect of the invention, an ink jet recording apparatus is mounted with the ink jet head unit according to any one of the first to ninth aspects. Therefore, by using the compact ink jet head unit, the apparatus can be miniaturized.

The present disclosure relates to subject matter contained in priority Japanese Patent Application Nos. 2003-124099, 2003-124100, 2003-124101 and 2003-124102 all filed on Apr. 28, 2003, the content of which is herein expressly incorporated by reference in its entirety.

What is claimed is:

1. An ink jet head unit comprising:

a head having a first surface and a second surface which is opposite relative to said first surface, the first surface comprising a first nozzle array and a second nozzle array which is arranged parallel to said first nozzle array with a predetermined spacing, each of said first and second nozzle arrays having plural nozzle holes for ejecting ink;

a plurality of flexible flat cables, each of said flat cables comprising a transmission wire for driving said head;

a plurality of connectors provided on a fixing part of said second surface of said head, said connectors being connected with said flat cables, respectively, wherein said fixing part is opposite to an area between said first nozzle array and said second nozzle array in said first surface; and a metallic interference preventing member or a nonmetallic interference preventing member in which a metal layer is formed, wherein said interference preventing member is arranged at least partly between said flat cables.

2. The ink jet head unit according to claim 1, wherein said flat cables are arranged so that said transmission wires formed therein are not parallel to each other.

3. An ink jet head unit comprising:

a head having a first surface and a second surface which is opposite relative to said first surface, the first surface comprising a first nozzle array and a second nozzle array which is arranged parallel to said first nozzle array with a predetermined spacing, each of said first and second nozzle arrays having plural nozzle holes for ejecting ink;

a plurality of flexible flat cables, each of the flat cables comprising a transmission wire for driving said head; and a plurality of connectors provided on a fixing part of said second surface of said head, said connectors being connected with said flexible flat cables, respectively, wherein said fixing part is opposite to an area between said first nozzle array and said second nozzle array in said first surface, and said flat cables extend from said head in the same direction, wherein each of the flat cables includes a driver, which generates an ink ejection signal for driving said head, and a heat radiation plate, wherein the driver and heat radiation plate are provided in a midway position of said respective flat cable and the locations of said drivers are shifted relative to each other.

4. The ink jet head unit according to claim 1, further comprising a head base on which said head is mounted, said head base including a notch part into which said flat cables are fitted, and notch part is formed on a side surface of said head base.

5. The ink jet head unit according to claim 1, further comprising a head base on which said head is mounted, each of said flat cables having at least two bending parts in the vicinity of said head base.

6. An ink jet head unit comprising:

a head in which a first nozzle array and a second nozzle array of which each comprises a plurality of nozzle holes for ejecting ink therefrom;

a head base on which said head is mounted; and a plurality of flat flexible cables, each of said cables comprising a plurality of transmission wires covered with an insulation film, wherein one end side of each of said flat flexible cables, where said transmission wires are exposed, is fixed in a mounted part interposed between the first nozzle array and the second nozzle array, onto said head thereby to transmit an ink ejection signal for driving said head, wherein a metallic interference preventing member or a nonmetallic interference preventing member in which a metal layer is formed is arranged at least partly between said flat cables.

7. The ink jet head unit according to claim 6, wherein said flat cable is arranged, within a width of said head in a direction orthogonal to a surface of the flat cable, along said head base.

8. The ink jet head unit according to claim 6, wherein said flat cables extend from said head in the same direction.

9. The ink jet head unit according to claim 6, wherein said flat cables are arranged so that said transmission wires formed in these flat cables are not parallel to each other.

10. An ink jet head unit comprising:

a head in which a first nozzle array and a second nozzle array of which each comprises a plurality of nozzle holes for ejecting ink therefrom;

a head base on which said head is mounted; and a plurality of flat flexible cables, each of said flat cables comprising a plurality of transmission wires covered with an insulation film, wherein one end side of each of said flat flexible cables, where said transmission wires are exposed, is fixed in a mounted part interposed between the first nozzle array and the second nozzle array, onto said head thereby to transmit an ink ejection signal for driving said head, wherein each of the flat cables includes a driver, which generates an ink ejection signal for driving said head, and a heat radiation plate, wherein the driver and heat radiation plate are provided in a midway position of said respective flat cable, and the locations of said drivers are shifted relative to each other.

11. The ink jet head unit according to claim 10, wherein said head base includes a notch part into which said flat cables are fitted, and said notch part is formed on a side surface of said head base.

12. The ink jet head unit according to claim 10, wherein each of said flat cables has at least two bending parts in the vicinity of said head base.

13. An ink jet head unit comprising:

a head that has a first surface and a second surface which is opposite relative to said first surface, an ink chamber and an ink flow path, said first surface comprising a first nozzle array and a second nozzle array which is arranged with a predetermined spacing, each of said first and second nozzle arrays having plural nozzle holes for ejecting ink; and a transmission line that is electrically connected with said head on a fixing part of said second surface for driving said head, said fixing part being opposite to an area between said first nozzle array and said second nozzle array in said first surface.

14. The ink jet head unit according to claim 13, further comprising a head base that mounts said head and has a side surface perpendicular to said second surface, wherein said transmission line comprises a first portion that is arranged along said second surface, a second portion that is arranged along said side surface and a curved transitional portion that is arranged between said first portion and said second portion.

15. The ink jet head unit according to claim 14, wherein said second portion is arranged within a space over said second surface.

16. The ink jet head unit according to claim 15, wherein said side surface comprises a recess, said second portion being arranged in said recess.

17. The ink jet head unit according to claim 16, wherein said transmission line further comprises a third portion extending to opposite direction to said curved transitional portion, said third portion having a bending portion.

18. The ink jet head unit according to claim 17, wherein said transmission line is a flexible flat cable and comprises a plurality of transmission wires covered with an insulation film.

19. An ink jet head unit comprising:

a head that has a first surface and a second surface which is opposite relative to said first surface, an ink chamber and an ink flow path, said first surface comprising a nozzle array, said first nozzle array having plural nozzle holes for ejecting ink;

a head base that mounts said head and has a side surface perpendicular to said second surface, and a transmission line that is electrically connected with said head on said second surface for driving said head, said transmission line comprising a first portion arranged along said second surface, a second portion arranged along said side surface, and a curved transition portion arranged between said first portion and said second portion, wherein said second portion is arranged within a space over said second surface.

20. The ink jet head unit according to claim 19, wherein said side surface comprises a recess, said second portion being arranged in said recess.

21. The ink jet head unit according to claim 20, wherein said transmission line further comprises a third portion extending in a direction that is opposite direction relative to said curved transition portion, said third portion having a bending portion.

22. The ink jet head unit according to claim 21, wherein said transmission line is a flexible flat cable and comprises a plurality of transmission wires covered with an insulation film.

23. The ink jet head unit according to claim 6, wherein said head base includes a notch part into which said flat cables are fitted, and notch part is formed on a side surface of said head base.

24. The ink jet head unit according to claim 6, wherein each of said flat cables has at least two bending parts in the vicinity of said head base.

25. The ink jet head unit according to claim 13, wherein the first and second nozzle arrays extend along a longitudinal direction of the first surface and are parallel to each other.

* * * * *